US012723854B2

(12) United States Patent
Sanford

(10) Patent No.: US 12,723,854 B2
(45) Date of Patent: Sep. 1, 2026

(54) BROADHEAD

(71) Applicant: Chris G. Sanford, Molt, MT (US)

(72) Inventor: Chris G. Sanford, Molt, MT (US)

( * ) Notice: Subject to any disclaimer, the term of this patent is extended or adjusted under 35 U.S.C. 154(b) by 433 days.

(21) Appl. No.: 18/132,284

(22) Filed: Apr. 7, 2023

(65) Prior Publication Data

US 2024/0337472 A1 Oct. 10, 2024

(51) Int. Cl.
*F42B 6/08* (2006.01)

(52) U.S. Cl.
CPC ..... *F42B 6/08* (2013.01)

(58) Field of Classification Search
CPC ..... F42B 6/08
USPC ..... 473/583
See application file for complete search history.

(56) References Cited

U.S. PATENT DOCUMENTS

| | | | | | |
|---|---|---|---|---|---|
| 3,138,383 | A * | 6/1964 | Mckinzie | F42B 6/08 | 43/6 |
| 3,738,657 | A * | 6/1973 | Cox | F42B 6/08 | 473/585 |
| 4,166,619 | A * | 9/1979 | Bergmann | F42B 6/08 | 473/581 |
| 4,932,671 | A * | 6/1990 | Anderson, Jr. | F42B 6/08 | 473/583 |
| 5,082,292 | A * | 1/1992 | Puckett | F42B 6/08 | 473/583 |
| 5,100,143 | A * | 3/1992 | Puckett | F42B 6/08 | 473/583 |
| 5,112,063 | A * | 5/1992 | Puckett | F42B 6/08 | 473/583 |
| 5,322,297 | A * | 6/1994 | Smith | F42B 6/08 | 473/583 |
| 5,458,341 | A * | 10/1995 | Forrest | F42B 6/08 | 473/583 |
| 5,564,713 | A * | 10/1996 | Mizek | F42B 6/08 | 473/583 |
| 6,165,086 | A * | 12/2000 | Liechty | F42B 6/08 | 473/583 |
| 6,517,454 | B2 * | 2/2003 | Barrie | F42B 6/08 | 473/583 |
| 6,669,586 | B2 * | 12/2003 | Barrie | F42B 6/08 | 473/583 |
| 6,910,979 | B2 * | 6/2005 | Barrie | F42B 6/08 | 473/583 |
| 7,713,151 | B2 * | 5/2010 | Fulton | F42B 6/08 | 473/583 |
| 7,713,152 | B1 * | 5/2010 | Tentler | F42B 6/08 | 473/583 |
| 7,771,298 | B2 * | 8/2010 | Pulkrabek | F42B 6/08 | 473/583 |
| 8,007,382 | B1 * | 8/2011 | Sanford | F42B 6/08 | 473/583 |
| 8,016,704 | B1 * | 9/2011 | Vandewater | F42B 6/08 | 473/583 |

(Continued)

FOREIGN PATENT DOCUMENTS

| | | | |
|---|---|---|---|
| CA | 2614446 | A1 | 12/2008 |
| CA | 2757738 | A1 | 6/2012 |

(Continued)

*Primary Examiner* — Alexander R Niconovich
(74) *Attorney, Agent, or Firm* — Becker Patent Law, LLC

(57) ABSTRACT

A broadhead has at least two overlapping blades received within an elongated groove, each blade having a blade extension, the blades are able to pivot without interference.

30 Claims, 33 Drawing Sheets

(56) References Cited

U.S. PATENT DOCUMENTS

| | | | | |
|---|---|---|---|---|
| 8,105,187 | B1 * | 1/2012 | Sanford | F42B 6/08 473/583 |
| 8,128,521 | B1 * | 3/2012 | Ulmer | F42B 6/08 473/583 |
| 8,147,361 | B1 * | 4/2012 | Weaver | F42B 6/08 473/583 |
| 8,197,367 | B2 * | 6/2012 | Pulkrabek | F42B 6/08 473/583 |
| 8,313,399 | B2 * | 11/2012 | Sanford | F42B 6/08 473/583 |
| 8,393,983 | B1 * | 3/2013 | Sanford | F42B 6/08 473/583 |
| 8,398,510 | B1 * | 3/2013 | Mizek | F42B 6/08 473/583 |
| 8,449,415 | B2 * | 5/2013 | Grace | F42B 6/08 473/583 |
| 8,469,842 | B2 * | 6/2013 | Mizek | F42B 6/08 473/583 |
| 8,469,843 | B2 * | 6/2013 | Mizek | F42B 6/04 473/583 |
| 8,512,179 | B2 * | 8/2013 | Pulkrabek | F42B 6/08 473/583 |
| 8,905,874 | B2 * | 12/2014 | Sullivan | F42B 6/08 473/583 |
| 8,911,311 | B1 * | 12/2014 | Mizek | F42B 6/04 473/583 |
| 8,926,457 | B2 * | 1/2015 | Treto | F42B 6/08 473/583 |
| 9,028,349 | B2 * | 5/2015 | Budris | F42B 6/08 473/583 |
| 9,068,806 | B2 * | 6/2015 | Pedersen | F42B 12/34 |
| 9,267,773 | B2 * | 2/2016 | Mizek | F42B 6/08 |
| 9,372,056 | B2 * | 6/2016 | Sullivan | F42B 12/34 |
| 9,526,234 | B2 * | 12/2016 | Harshberger | A01K 99/00 |
| 9,664,484 | B2 * | 5/2017 | Mizek | F42B 6/08 |
| 9,803,962 | B2 * | 10/2017 | Hahn | F42B 6/08 |
| 9,857,152 | B2 * | 1/2018 | Franco, Sr. | F42B 6/08 |
| 9,903,693 | B2 * | 2/2018 | Salvino | F42B 6/08 |
| 9,945,647 | B2 * | 4/2018 | Pugliese | F42B 6/08 |
| 9,945,648 | B2 * | 4/2018 | Grace | F42B 6/08 |
| 10,281,250 | B2 * | 5/2019 | Beck | F42B 6/08 |
| 10,288,392 | B2 * | 5/2019 | Haas | F42B 6/08 |
| 10,309,754 | B2 * | 6/2019 | Pugliese | F42B 12/34 |
| 10,598,470 | B1 * | 3/2020 | Sanford | F42B 6/08 |
| 10,623,808 | B2 * | 4/2020 | Pedersen | H04N 21/8106 |
| 10,746,514 | B1 * | 8/2020 | Stacy | F42B 6/08 |
| 10,809,044 | B2 * | 10/2020 | Perry | F42B 6/08 |
| 11,137,235 | B2 * | 10/2021 | Fischer | F42B 6/08 |
| 11,448,492 | B1 * | 9/2022 | Futtere | F42B 6/08 |
| 11,898,834 | B1 * | 2/2024 | Major | F42B 6/08 |
| 2009/0203477 | A1 * | 8/2009 | Mizek | F42B 6/08 473/583 |
| 2016/0195377 | A1 * | 7/2016 | Mizek | F42B 6/08 473/583 |
| 2019/0212112 | A1 * | 7/2019 | Buchanan | F42B 12/34 |

FOREIGN PATENT DOCUMENTS

| | | | |
|---|---|---|---|
| EP | 2977712 | A1 | 1/2016 |
| EP | 3062061 | A1 | 8/2016 |
| WO | 2014168800 | A1 | 10/2014 |

* cited by examiner

BROADHEAD

BACKGROUND

The present disclosure relates to a broadhead with retracted blades that pivot outwardly into an expanded position upon target contact and more particularly, but not by way of limitation, to an arrow broadhead having a cutting blade housing body with an elongated groove extending along a portion of a length of the housing body. The groove is used to receive a pair of cutting blades. The cutting blades are received in opposite sides of the groove when the broadhead is in a retracted position during arrow flight. Upon target contact, the blades may pivot outwardly from the sides of the groove into an expanded position for maximum cutting and target penetration.

BRIEF DESCRIPTION OF THE DRAWINGS

The accompanying drawings illustrate various embodiments for broadheads in which:

FIG. 12A are illustrations of various blade retention devices that hold and press the blades keeping them in a retracted in-flight position. This retention device can be attached to the body, blade, or a pin screw, etc.

DETAILED DESCRIPTION OF EXEMPLARY EMBODIMENTS

Figure 1:
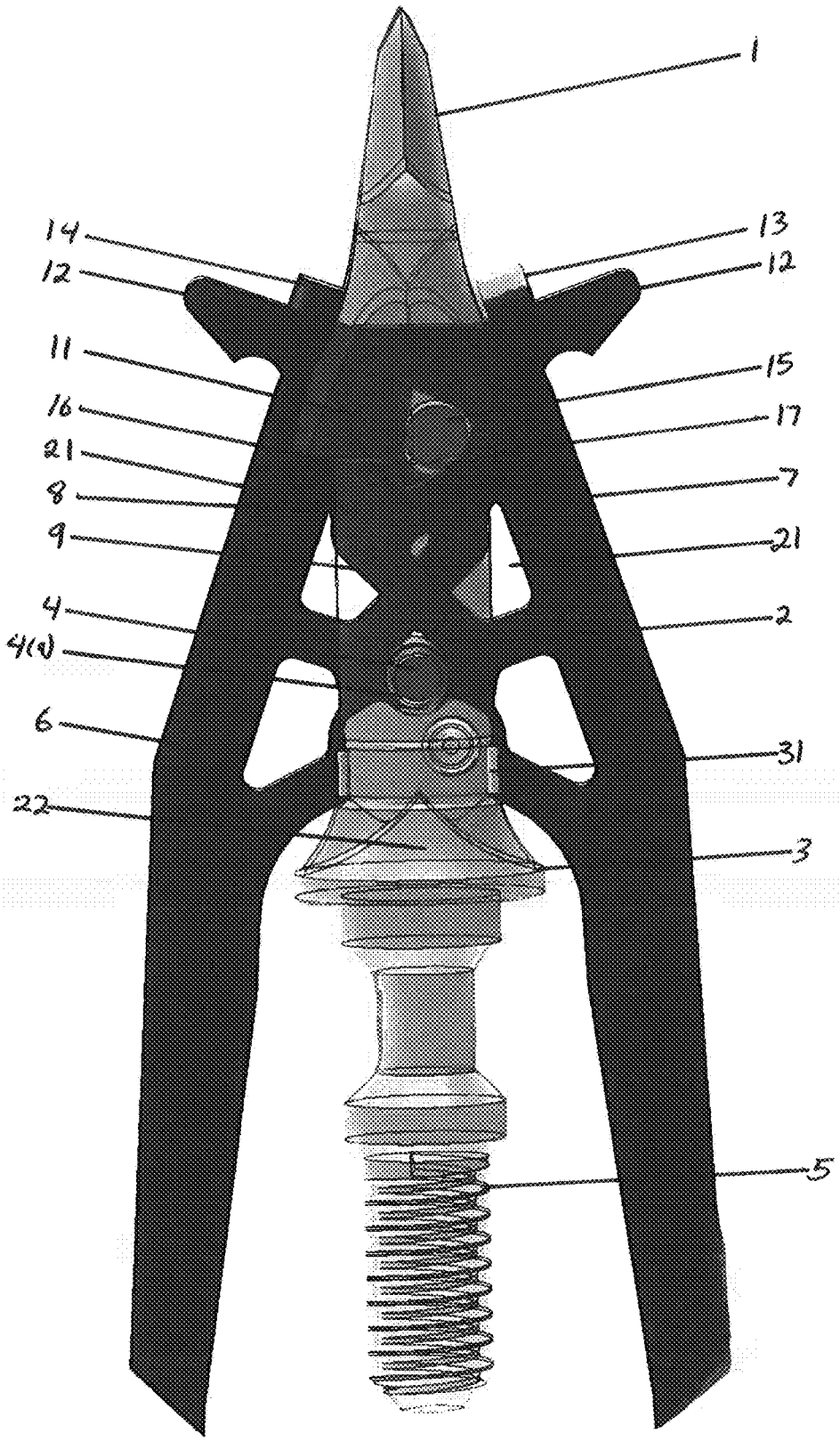
FIG. 1 is a front view of an arrow broadhead with a pair of cutting blades received inside an elongated groove in the housing body, according to an exemplary embodiment. This is an in-flight position. The blades are retracted inwardly toward the housing body.

Various embodiments provide a broadhead with a pair of cutting blades in a retracted position in a groove in a cutting blade housing body during arrow flight, hold the cutting blades in an expanded, locked position during target contact, and then allow the cutting blades to fold forward for ease in release when the broadhead is pulled outwardly from the target which may make it a non-barbed design.

Other embodiments illustrate how an arrow broadhead housing can include a tip that allows detachment from the housing body. The separate, detachable tip can be attached to a top portion of the housing body, which may allow the rotating, sliding, or pivoting cutting blades to be received in the elongated groove. This feature may allow for a connected pair of blades or at least one blade to be received in an elongated groove.

Still other embodiments relate to multiple features or blade extensions on cutting blades to be received in a cutting blade housing body or elongated groove. The blade extensions can be in the form of a bend in the blade, an extrusion on the blade, a bump or outward extension from the blade, a screw in the blade, a rivet in the blade, a screw pin, a protruding portion of the blade, a molded outward portion on the blade, or other extensions. The blade extrusion can be of different shapes, sizes, and combinations thereof. The extrusion can be any component or portion of the blade that is wider than at least one blade thickness. The blade extension on at least one blade can be wider than the blade slot of the blade housing body. This blade feature can be any makeup that creates a non-parallel portion to the blade length. This feature may allow the blade or blades to be received within the elongated groove.

Still other embodiments relate to the blade or blades extending from one side of the housing body through the other side of the housing body.

Still other embodiments relate to a pair of cutting blades crossed over one another and at least partially received in an elongated groove or slot in the housing body. The blades have a forward portion that, upon target contact, push rearwardly and move the blades outward into an expanded position for increased cutting and penetration in the target.

Still other embodiments relate to using the broadhead's forward inertia to hold the cutting blades in the elongated groove in the housing body to approximately upon target contact, then moving the cutting blades into a fully expanded and locked position. The forward inertia of the arrow broadhead and the extension of the blades may provide for an improved cutting and tissue damage to the intended target. This feature results in larger entry and exit holes in the target, better blood trails and higher game recovery.

Still other embodiments relate to having at least one blade extension with a non-parallel portion of the face of the blade that couples at least one blade to the body. In still other embodiments, the blade extension may be any portion of the blade that breaks the plane of the flat portion of the blade face. Still other embodiments relate to having at least one blade extension having a non-parallel portion to the face of the blade that couples the blade to at least one other blade.

Still other embodiments relate to various blade retention devices to hold the blades into a retracted in-flight position during arrow flight. The blade retention devices can be a spring clip, spring bump-out, spring extrusion, spring tension, spring blade portion, steel ring, O-ring, rubber ring, half ring, plastic clip over any portion of the blades, spring ring, tension ring, tension ring pushing on blades, tension ring covering blades, tension ring pulling blades inward, tension wire, tension wire pulling on blade extrusions and keeping blades retracted, tension ring pushing against the blades, torsional spring or tension clip over a portion of the blades or pressing against the blades, of any size, shape, or combinations thereof. Still other embodiments relate to various blade retention devices to hold at least one blade into a retracted position during arrow flight. The blade retention devices can relate to a spring tension clip or element that pushes against at least one blade or housing body or blade extension. In other embodiments, the blade retention device can be clipped to at least one blade, housing body, outside of housing body, inside of blade slot, pressed fit, screwed, snapped on, screwed or fastened or any combination thereof. In other embodiments, the blade retention portion can be a bump-out, extrusion, wire, spring, or any shape or form that applies pressure against at least one blade. In other embodiments, the blade retention portion can be any shape or form that provides pressure or tension to at least one blade against a portion of the body or blade extension. Still other embodiments comprise a blade retention device with a spring clip attached to housing body that compresses in the blade. Still other embodiments comprise a blade retention device with a spring clip attached to the housing body that compresses against the blade. Still other embodiments comprise a blade retention device with a cut-out in the blade or extension from the blade, creating a spring-like tension that couples to a pin, extension, or housing body to hold the blades in a retracted in-flight position.

In one embodiment the broadhead may include a pair of cutting blades received in an elongated groove in a cutting blade housing body. The cutting blades may be folded into a portion of the groove during arrow flight. Upon target contact, the blades may be configured to move rearward and outward from opposite sides of the groove into an expanded position for increased cutting and penetration in the target.

In some embodiments, a plurality of blades can overlap each other within a channel of a body or ferrule.

In some embodiments, blade extensions on each blade can be configured to contact and move along an outer surface of the ferrule without being confined to moving within a channel of the ferrule.

In some embodiments, providing blade extensions on one side of each blade extending in opposite directions allows the blades to overlap each other while still being able to rotate, and may further allow the blades to be kept in a smaller or more compressed circumference during an in-flight position for better aerodynamics and flight. Opposing blade extensions extending from one side of each blade may further allow the blades to rotate freely from a retracted in-flight position to an extended cutting position to a non-barbed position. In still other embodiments, the blade extension couples at least one blade to the housing body, while allowing at least one other blade to rotate.

In some embodiments, blade extensions may be configured to couple the blades to the housing body and may further be configured to align the blades to slide rearward into an expanded cutting position. The coupling between the blades and the housing body can be a movable coupling allowing the blades to rotate relative to the housing and/or to slide rearward relative to the housing.

In some embodiments, an additional blade extension on an inner portion of the blade (extending opposite the aforementioned blade extension) and the blade slot on the opposite blade may couple the two blades together within the elongated groove of the ferrule which may allow the blades to rotate freely from a retracted in-flight position to an extended cutting position, to a non-barbed position, while retaining the blades within the body. Still other embodiments relate to at least one blade extension coupling a blade to the housing body while allowing at least one other blade to move and rotate. In still other embodiments, the blade extension presses against a portion of a body housing pin, or other extensions to lock the blades into an expanded position.

In some embodiments, a broadhead body may comprise an exterior or outside bump or may have a recessed portion for the blade extensions to lock the blades into an expanded position. In some embodiments, the blade extensions are configured to hook over this portion of the body and pry against the body to lock the blades into an expanded cutting position.

In some embodiments, the blades may be coupled together and to the body without requiring the use of fasteners on the body to retain the blades. In some embodiments, the blades may be coupled together with a member that is not connected to at least one blade. In some embodiments, the blades may be coupled together with a member that is movable within at least one blade. In some embodiments, the blades may be coupled together with a member that is contained within at least one blade. In some embodiments, the blades may be coupled together with a member that is movable within the housing body. In some embodiments, the blade may be coupled together with a member that is wider than at least one blade thickness. In some embodiments, the blades may be coupled together with a member that is movable and contained within the blade slot within the housing body. In some embodiments, the blades may be coupled together with a movable component that is contained within a portion of the body. In some embodiments, the blades may be coupled together with a movable component and coupled to a portion of the body that is contained within the body. In some embodiments, the blades may be coupled together with a movable component within a portion of the blade that is coupled within a portion of the body. In still other embodiments, one blade is coupled to another blade by a moving component or a free-floating component. In still other embodiments, at least one blade is coupled with a movable component within a portion of the blade slot in the housing body. In some embodiments, one blade has an extension that is non-conflicting to another blade with an extension that couples both blades to the housing body. In some embodiments, one blade has an extension that is non-conflicting with another blade with an extension and also allows the blades to overlap each other and have a rotating motion. In some embodiments, at least one blade has an extension element that allows another blade with an extension element to be parallel to each other with no interference. In some embodiments, at least one blade has an extension that allows another blade with an extension element, wherein the blade extensions couple the blades to the housing body.

In some embodiments, the blade extension may be removable to allow the blades to be inserted in a body or elongated groove without having a slot completely through the end of the body or without having to remove a tip to insert the blades.

The various features of the embodiments disclosed herein show novel construction, combination, and elements as described, and more particularly defined by the claims, it being understood that changes in the embodiments to the disclosed invention are meant to be included as coming within the scope of the claims.

In FIG. 1, a front view of the subject broadhead is shown, having a general reference number 10. The broadhead 10 is illustrated in flight. The broadhead 10 includes a housing body 2, having a pointed tip 1 and a threaded end 5 used for attaching the broadhead 10 to a hollow arrow shaft insert. It should be noted that broadhead 10 can be glued, press fit, or attached to an arrow without the use of threaded end 5. Broadhead 10 can be made as an extension of an arrow, bolt, or any combination thereof. The arrow shaft and insert aren't shown in the drawings. The housing body 2 has an elongated groove 21 extending from inner bottom portion 22 to the top portion of body 2, the groove 21 receiving a pair of cutting blades 6 and 7. It should be noted that the elongated groove 21 can be a slot, groove, cut-out, hole, recess, etc. to assist in receiving at least one cutting blade. It should also be noted that the elongated groove 21 can be of different depths, shapes, partial, full through, and can be through the tip 1 or without a tip 1.

Also shown in this front view are cutting blades 6 and 7 received in housing body 2 and overlapping one another in at least one position and optionally in all positions of the movable blades. The cutting blades 6 and 7 are illustrated each with an extension 13 and 14 that protrudes outward in opposite or opposing directions so the blades 6 and 7 can slide or rotate. Extensions 13 and 14 may extend normal, perpendicular, non-parallel or transverse to a major plane defined by the respective blade of each extension. The extensions 13 and 14 may help align and retain the blades 6 and 7 within the housing body 2. For example, extension 14 of blade 7 may be disposed against housing body 2 to prevent blade 7 from sliding out of elongated groove 21 from left to right as shown in FIG. 1. Extension 13 of blade 6 may act against housing body 2 to prevent blade 6 from sliding out of elongated groove 21 from right to left as shown in FIG. 1. Extensions 13 and 14 (shown in perspective view in FIG. 14) can be of various shapes and sizes and may compromise an addition, protruding portion, bend, rivet, screw, pin, extrusion, protuberance, nut or bolt, forged metal or composite, removable or detachable from blade, permanent, integrally formed with the blade, or any combination thereof. Each of blades 6 and 7 can also have multiple extensions to retain the blade or blades within the elongated groove 21 of housing body 2 (e.g., one extension disposed on each opposing side of groove 21, or other configuration). There may also be a member or component element 15 that is coupled within or disposed within slot 11 of blade 6 and slot 11 (*a*) of blade 7, coupling the blades together and/or coupling one or both blades to housing body 2. This member 15 is received in receiving slot 11 of blade 6. The member 15 and slots 11 and 11 (*a*) may help couple blades 6 and 7 together. Blade member 15 can also be various shapes, sizes, loose, movable, any material, permanently fixed to blade, forged to blade, a blade extension, removable or detachable from a blade, a loose piece of any shape, bump, a protruding portion, rivet, screw, cylinder, ball, sphere, pin, extrusion, nut or bolt, bend or any combination thereof. Member 15 may be a movable member and may further be free-floating within slot 11 and/or slot 11 (*a*), meaning member 15 is a component separate from blades 6 and 7. Any portion of the blade or attachment to the blade may extend non-parallel to a face of the blade. This coupling member can be connected to a portion of the blade or the housing body. This blade coupling member can slide in a groove within the elongated groove. This blade coupling member can be contained within a groove within the housing that moves the blades from an in-flight retracted position to an expanded, open position and to a non-barbed position. This blade coupling member can be movable in the body and within a portion of the blade. This member can extend between two or more blades. The blade coupling member can couple blades together and move within the housing body. This blade coupling member can be any element that protrudes the parallel face of at least one blade. The blade coupling member can also be any element that is wider than the blade width.

The slot 11 (see also FIG. 7) can also be of various shapes, sizes, open, closed and different combinations thereof. In this embodiment, slot 11 in blade 6 is a different shape than slot 11 (*a*) in blade 7. Blade coupling member 15 can be received in slots that are in different locations on or in housing body 2, for example in a top end portion, a middle portion, a bottom end portion, etc. In some embodiments, blade 6 and/or blade 7 may have an extension on only one side of the blade and not on both sides of the blade. In some embodiments, blade 6 and/or blade 7 may have an extension extending normal to and from a major face of the blade in only one direction. In this embodiment, the coupling member 15 is movable in slot 11 and 11 (*a*) of blades 6 and 7, respectively, which movement may be lateral movement and/or rotational movement. In some embodiments, blade coupling member 15 may extend between at least one blade and into a portion of the housing body. During assembly, the coupling member 15 may be inserted through an opening 4 (*a*) or pinhole or cutout or aperture in elongated body 21 and then through slots 11 and 11 (*a*). Opening 4 (*a*) may comprise a hole (e.g., circular or other shape) extending from an outer surface of housing body 2 to elongated slot 21 within housing body 2. During assembly, the blades may then be moved upward to slide movable member 15 from a position at opening 4 (*a*) to the position shown in FIG. 1 and to allow screw pin 4 to insert into pin hole 4 (*a*). This allows the blades to be captured within the blade slots and blade extensions. Also shown in FIG. 1 is blade locking notch 8 or protrusion that hooks or locks over or against screw pin 4 when the blade opens to ang expanded position (shown in greater detail in FIG. 2A and FIG. 2B). In the absence of screw pin 4, blades 6 and 7 can lock over or against inner body portion 22 or portion 3 of housing body 2.

Figure 2:
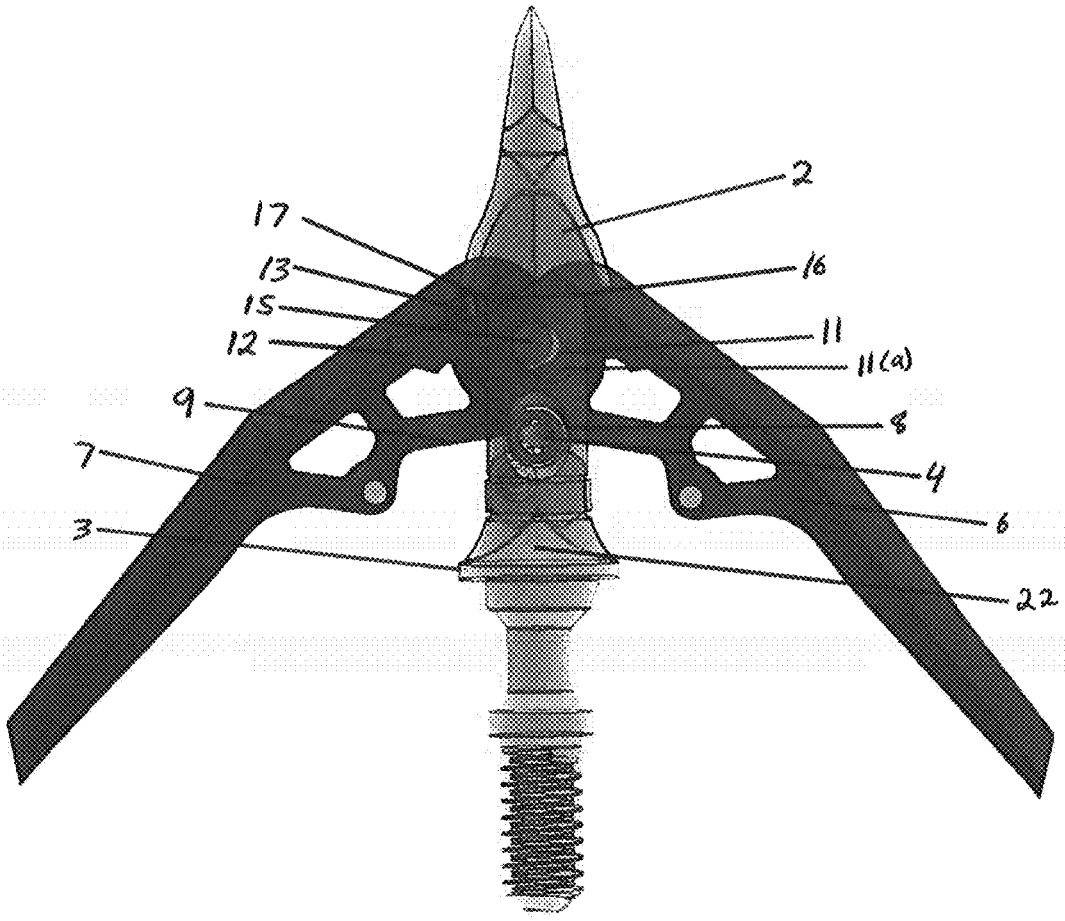
FIG. 2 is a rear view of the broadhead, as shown in FIG. 1, with the blades expanded outwardly for maximum cutting and target penetration.
Figure 2A:
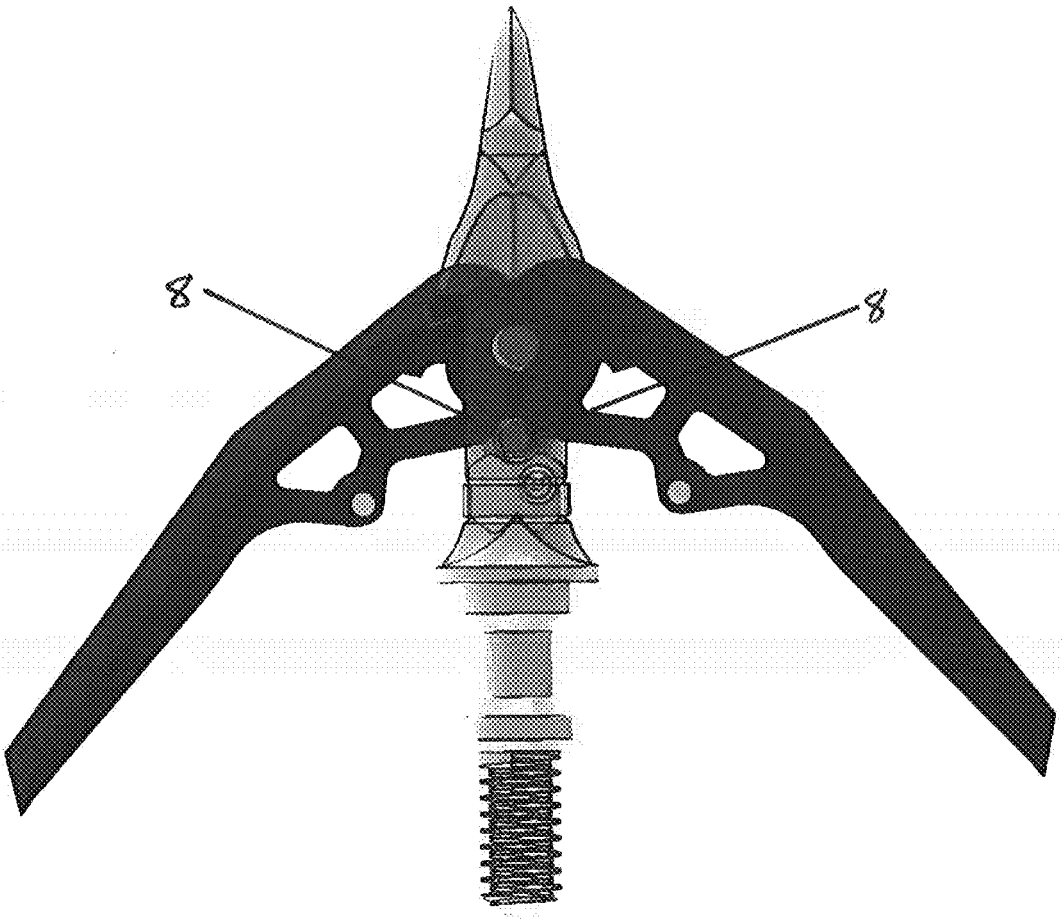
FIG. 2A is another rear view of the broadhead shown in FIG. 1.
Figure 2B:
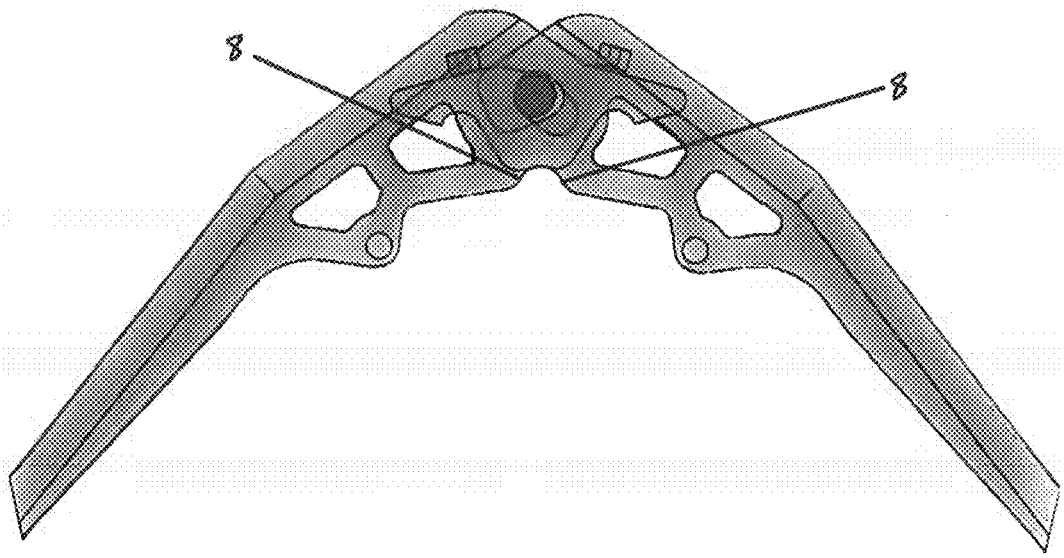
FIG. 2B is a rear view partial rear view of the broadhead shown in FIG. 1.

In FIG. 2 an expanded and locked illustration of a broadhead is shown with an expanded or angle portion 16 and 17 of housing body 2. This angle portion 16 and 17 can be a groove, cut-out, bump-out, hook, recess, or any combination thereof. Angle portion 16, 17 may comprise a bump-out portion of housing body 2 where the blade extensions 14 (not shown in this drawing) and blade extension 13 lock under and into and pry against screw pin 4 or inner body portion 22 and screw pin 4 or against or over bottom portion 3. This bump-out portion may comprise any area on the outside portion of housing body 2 that the blade extensions are captured in and that prevent the blade from sliding upward on the body and unlocking the blades or slide forward back in towards the in-flight position. Upon target contact, the front portion 12 of blades 6 and 7 push blades backward and inner blade portion 9 can contact outer bottom portion 3 or inner bottom portion 22 or screw pin 4 of housing body 2 that can help rotate or slide blades 6 and 7 outwardly into an expanded cutting position. Upon target contact, blade extensions 13 and 14 can also help push and rotate blades 6 and 7 outwardly into an expanded cutting position. Upon target contact, blade slots 11 and 11 (*a*) may align and assist blades 6 and 7 to move rearward and outwardly, and then upon target contact, blade coupling member 15 helps couple blade slot 11 and 11 (*a*) and holds the blades in an expanded locked position. Also, upon target contact, blade extensions 13 and 14 (not shown in this drawing) may slide rearward on the outer portion or surface of housing body 2 and then lock into portion 16 and 17 of housing body 2. This locks blades 6 and 7 into an expanded cutting position 23. Blade extensions 13 and 14 push or press against pin screw 4 or can also press against upper inner blade 22 or portion of housing body 2 and lock blades 6 and 7 into an expanded cutting position. In this illustration, lock notch 8 locks the blades 6 and 7 into an expanded cutting position, but bottom portion 3 can compromise a flat surface or angled surface of various shapes and angles. Blade lock notch 8 can also be a flat surface, angled surface, or various shapes or angles or combinations thereof. Blades 6 and 7 can lock open into an expanded cutting position by use of blade extensions 13 and 14 or by blade lock notch 8 over screw pin 4 or bottom portion 3 or housing body 2 or any combination thereof. Other blade extensions and combinations thereof can also be used to lock the blades into an expanded cutting position.

Figure 3:
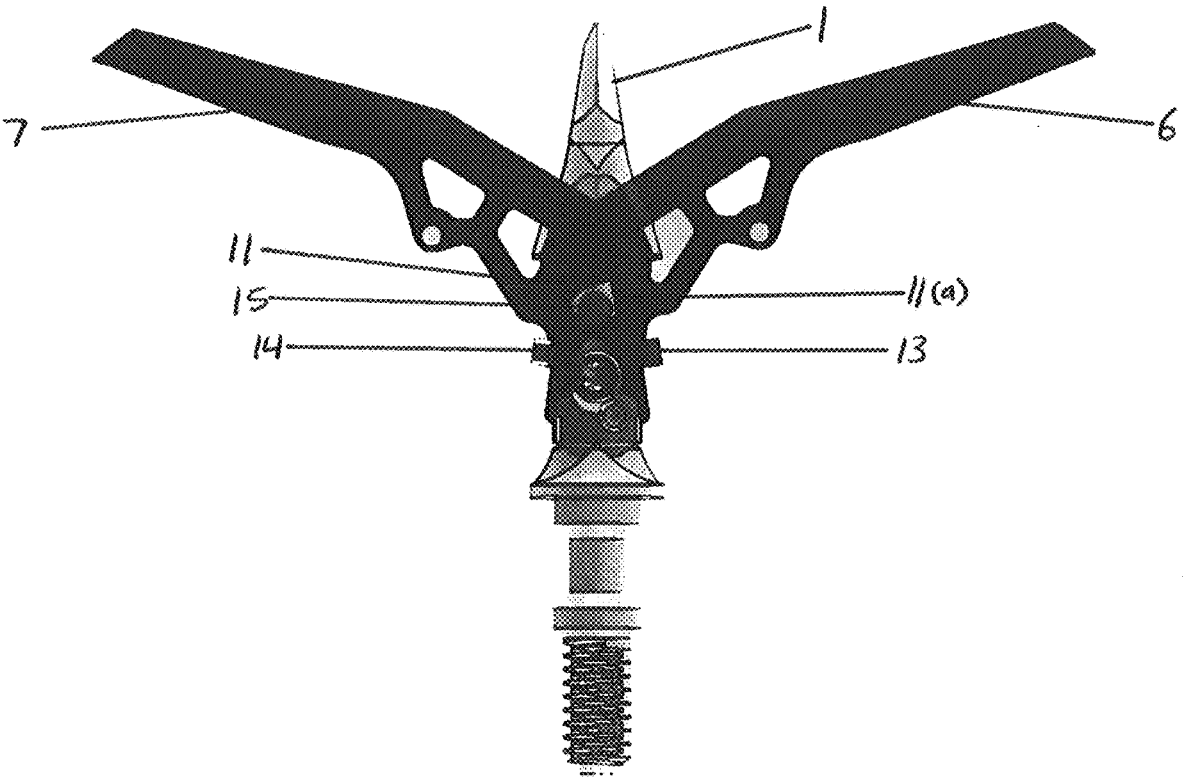
FIG. 3 is still another rear view of the broadhead, as shown in FIG. 1, with the cutting blades pulled rearwardly and pointing forwardly for releasing the broadhead from the target and illustrating a non-barbed design.

In FIG. 3 a view of the subject arrow broadhead is shown in a non-barbed position 47. The blades 6 and 7 are folded forward for easy release from the target. In this illustration, the extensions 13 and 14 still allow the blades 6 and 7 to rotate forward into the non-barbed position. While the blades 6 and 7 are illustrated in a locked position 23 in FIG. 2, the blades 6 and 7 can still rotate forward to this non-barbed position.

Figure 4:
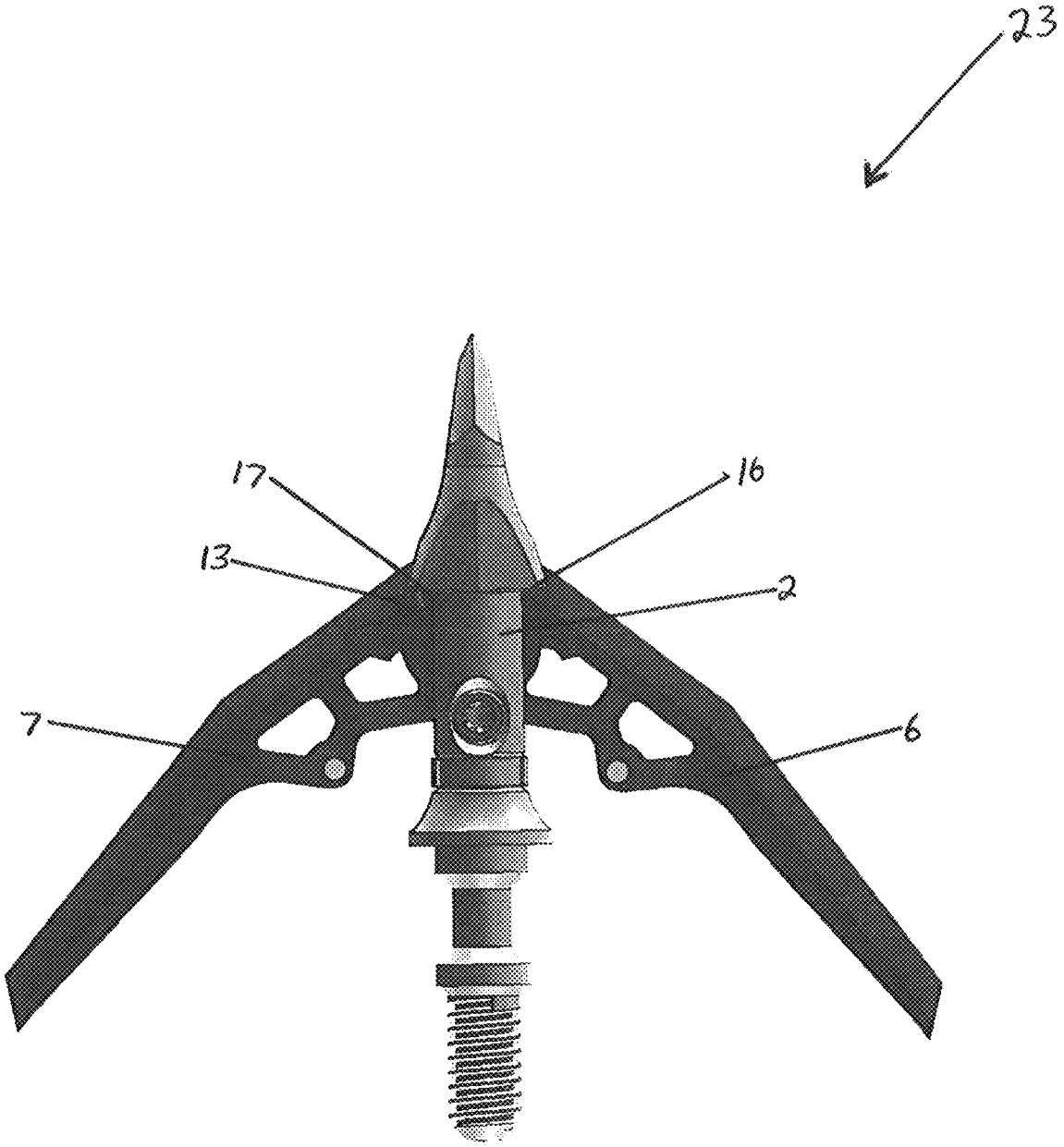
FIG. 4 is a rear view of the embodiment of the arrow broadhead with each cutting blade illustrating a first extension on one side and a second extension on the opposite side (not shown in this drawing) to receive the blades in an elongated groove in the housing body.

In FIG. 4, still another view of the subject broadhead 23 in an expanded and locked position illustrates how blade extension 13 of blade 6 is locked in and against bump-out portion 17 of housing body 2. Blade extension 14 of blade 7 is locked in and against bump-out portion 16 on the opposite side (not shown in this drawing).

Figure 5:
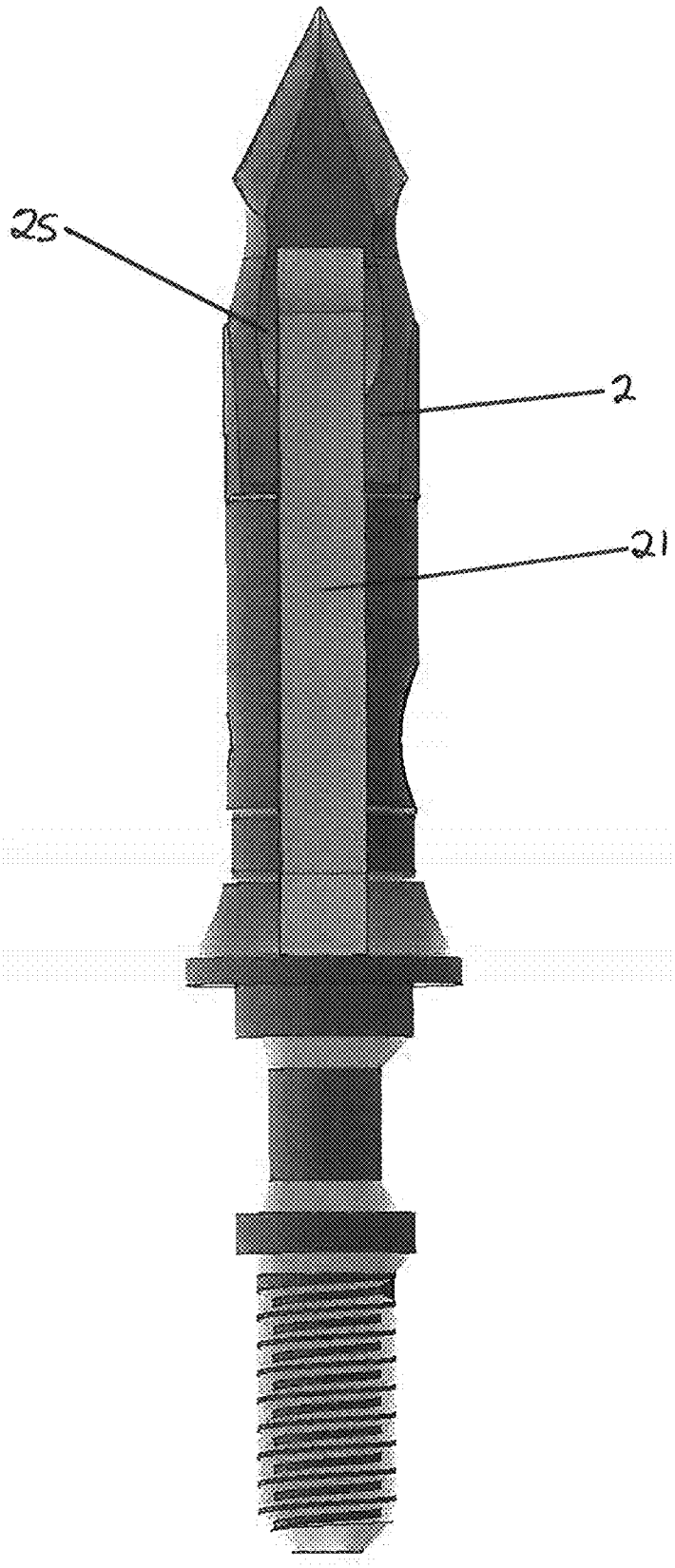
FIG. 5 is a side view of the housing body shown in FIG. 1, without the cutting blades. This illustration shows the elongated groove through a portion of the housing body.

In FIG. 5, is another perspective side view of housing body 2. In this view, the elongated groove 21 is illustrated through a portion of housing body 2. There is also a flat portion 25 for blade extensions 13 and 14 to easily slide on while blades 6 and 7 move rearwardly into an expanded and locked cutting position 23. It should be noted, blade extensions 13 and 14 can still slide or move rearwardly without flat portion 25. Blade extensions 13 and 14 can also slide in a rail or outer portion slot or elongated groove or in housing body 2.

Figure 6:
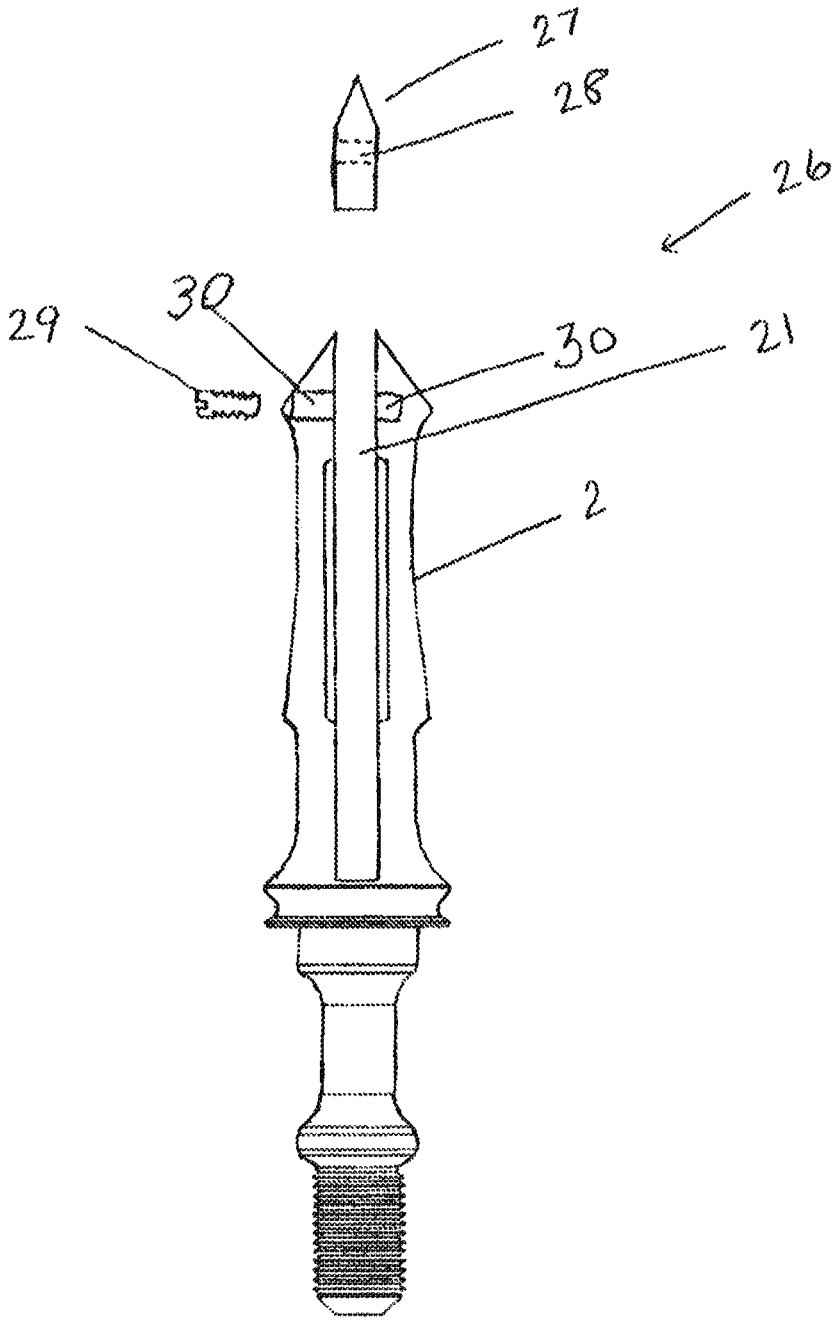
FIG. 6 is still another side view of another embodiment of an arrow broadhead with a removable bladed tip to receive a pair of cutting blades in the elongated groove.

FIG. 6 is another side view of an embodiment 26. In this illustration, the embodiment 26 has a replaceable blade tip 27 that is coupled to housing body 2 with a screw pin 29 through opening 28 of bladed tip 27 and coupled together through another housing body opening 30 in housing body 2. Opening 28 and 30 can also be threaded to receive bladed tip 27 with screw pin 29. It should be noted that bladed tip 27 can be coupled to housing body 2 with a screw, pin, press fit, glue, weld, or any other application to receive the tip. It should also be noted that the tip can be a rounded flat, cone shape, diamond shape, or of various shapes and sizes. Also illustrated in FIG. 6 is the elongated groove 21 extended through front portion of housing body 2 allowing blades 6 and 7 to be received without concern of blade extensions 13, 14, or member 15, or other multiple blade extensions.

Figure 7:
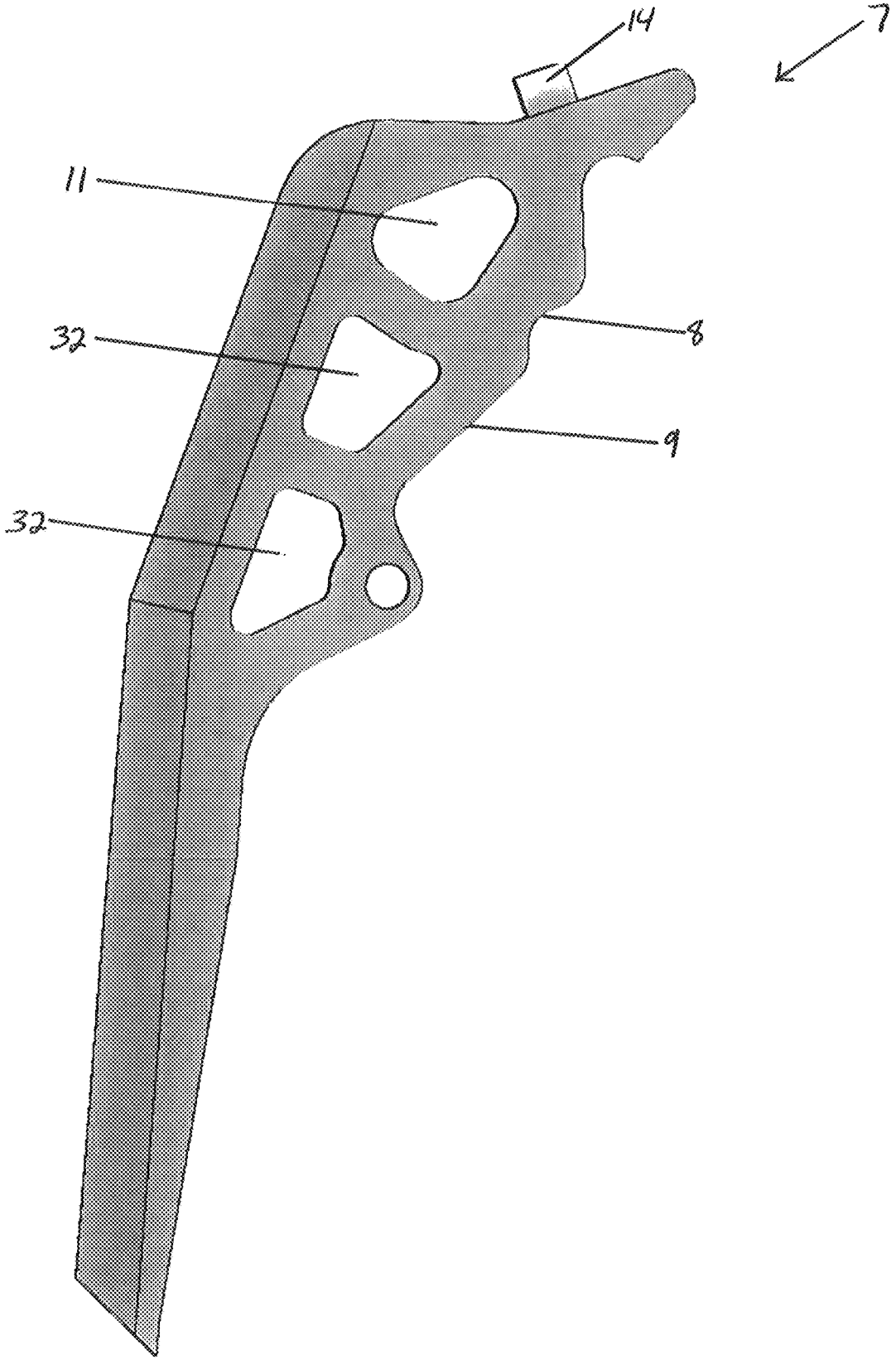
FIG. 7 is an illustration of a first blade with a blade extension in one direction and a blade receiving slot.

In FIG. 7 is an illustration of blade 7 with blade extension 14 and inner lower blade portion 9. Also in FIG. 7 are blade cut-outs 32 and receiving slot 11. This cut-out or receiving slot can also be any size or shape.

Figure 8:
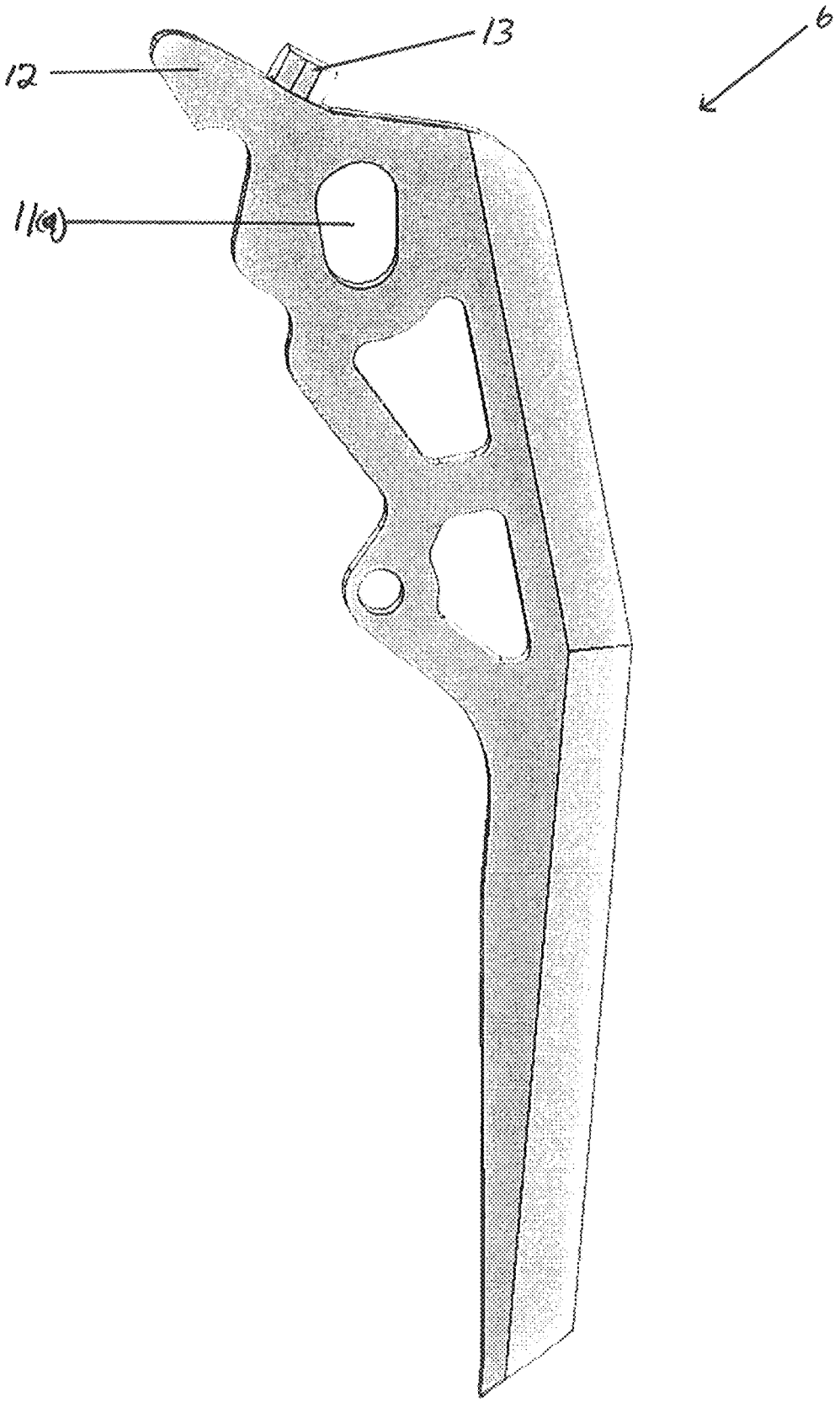
FIG. 8 is an illustration of a second blade with a blade extension in another direction and a receiving slot.

In FIG. 8 is an illustration of blade 6 with blade extension 13 and receiving slot 11 (*a*). Blade coupling member 15 (not shown in this drawing) may be received in receiving slot 11 (*a*) of blade 6. It should be noted that blade slot 11 (*a*) can be a cut-out, elongated groove, line, or slot that is open and continues through the edge of blade 6 allowing a blade extension 15 to not be fully contained in receiving slot 11 (*a*). Blade slots 11 and 11 (*a*) can extend through a portion of blades 6 and 7 and still couple blades together. With blade coupling member 15 received in receiving slot 11 and 11 (*a*), blades 6 and 7 are coupled together, yet still able to pivot, slide, and rotate. Also shown in this illustration is front portion 12 which helps push and rotate blade 6 backwardly and rearwardly into expanded cutting position.

Figure 9:
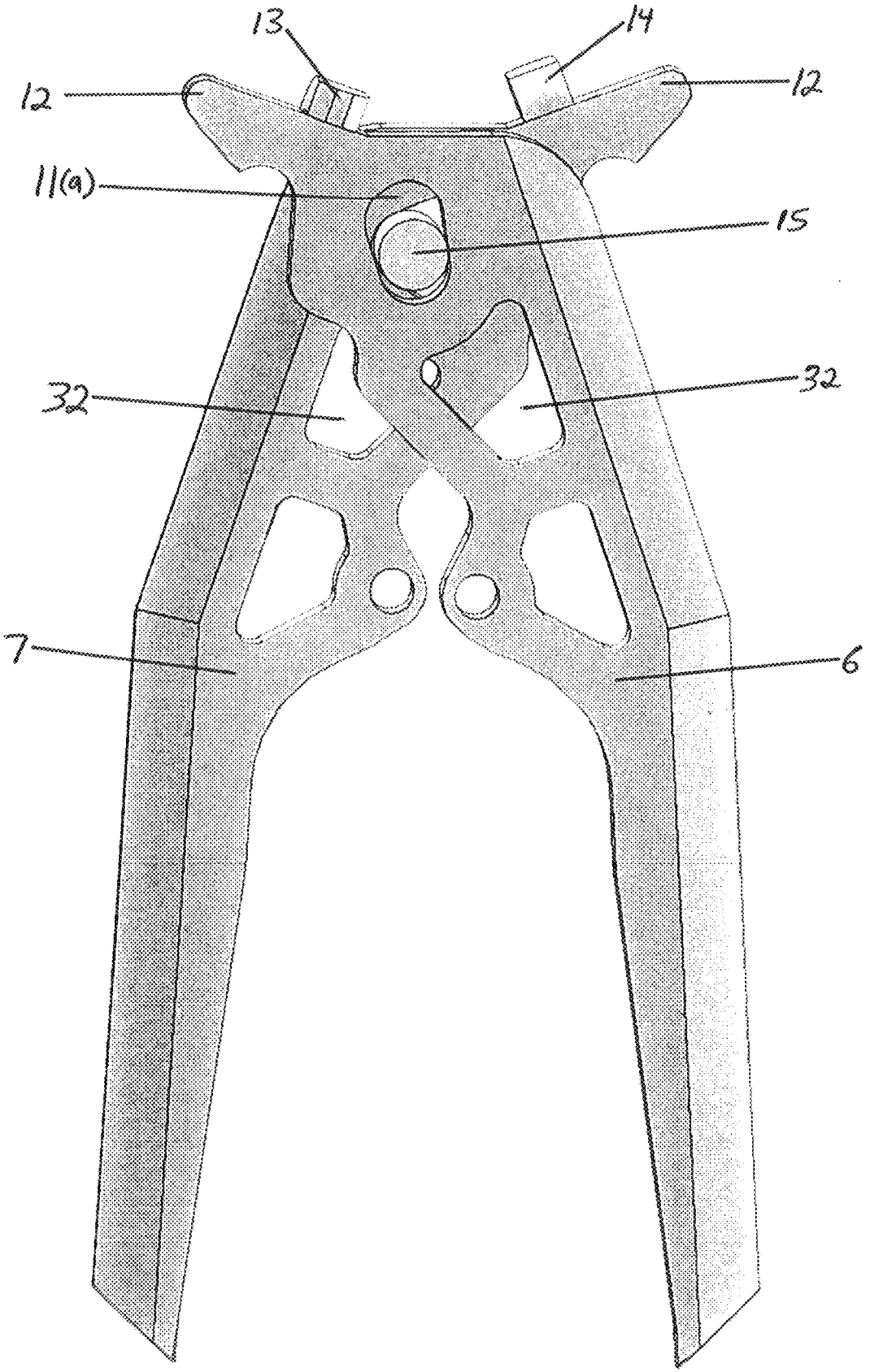
FIG. 9 is an illustration of a first blade overlapping the second blade without the housing body as shown in FIG. 1. This illustration also shows the blades coupled together with a free-floating blade coupling member and receiving slot.

In FIG. 9 is an illustration of blades 6 and 7 in the retracted position and without housing body 2 shown. In this illustration, member 15 is shown in receiving slot 11 (*a*) in a different position.

Figure 10:
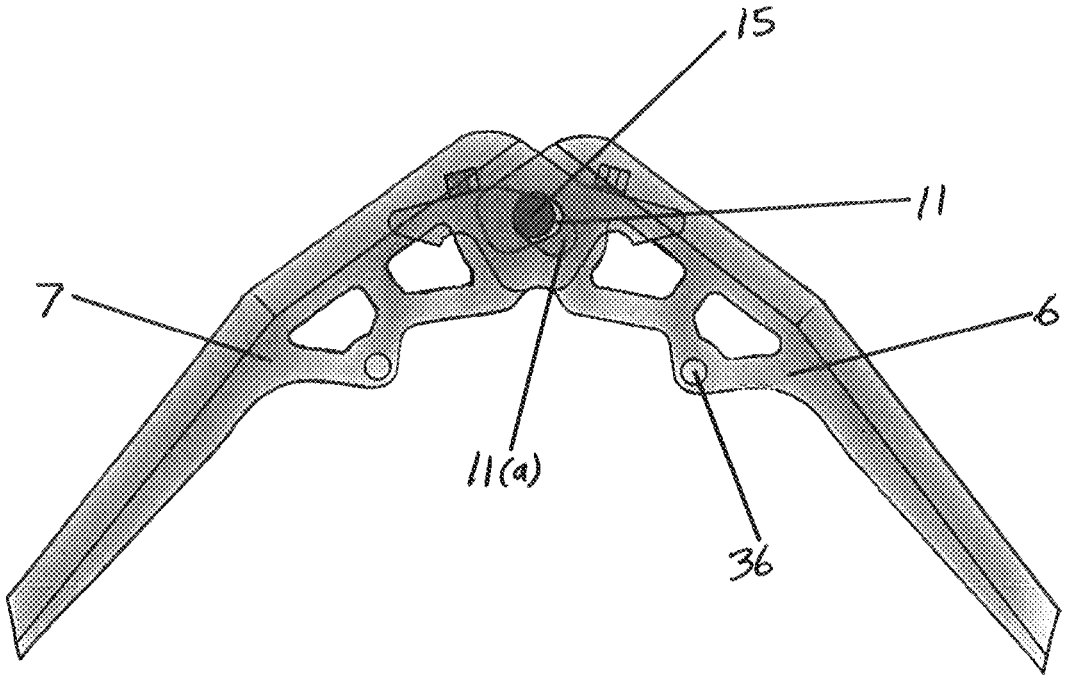
FIG. 10 is an illustration of a first and second blade in the expanded position without the housing body as shown in FIG. 1.

In FIG. 10 is an illustration of blades 6 and 7 in the expanded cutting position and without housing body 2 shown. In this illustration, member 15 is shown in a locked position in receiving slot 11 and 11 (*a*).

Figure 11:
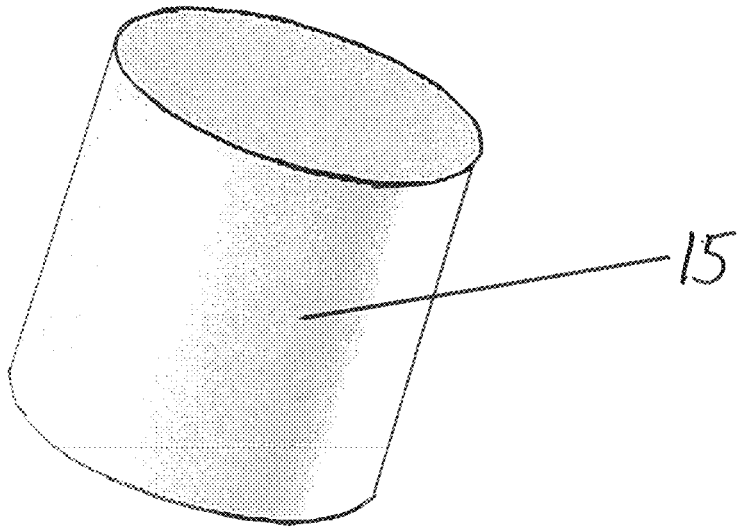
FIG. 11 is an illustration of a blade coupling member.

FIG. 11 is an illustration of member 15. It should be noted that blade coupling member can be any size or shape and be a movable part of the blade 6 and 7 and a permanent part of blade 6 or 7 or can be a detachable part of blade 6 or 7 or separate component from blade 6 or 7. Blade coupling member can also couple blades to body 2.

Figure 12:
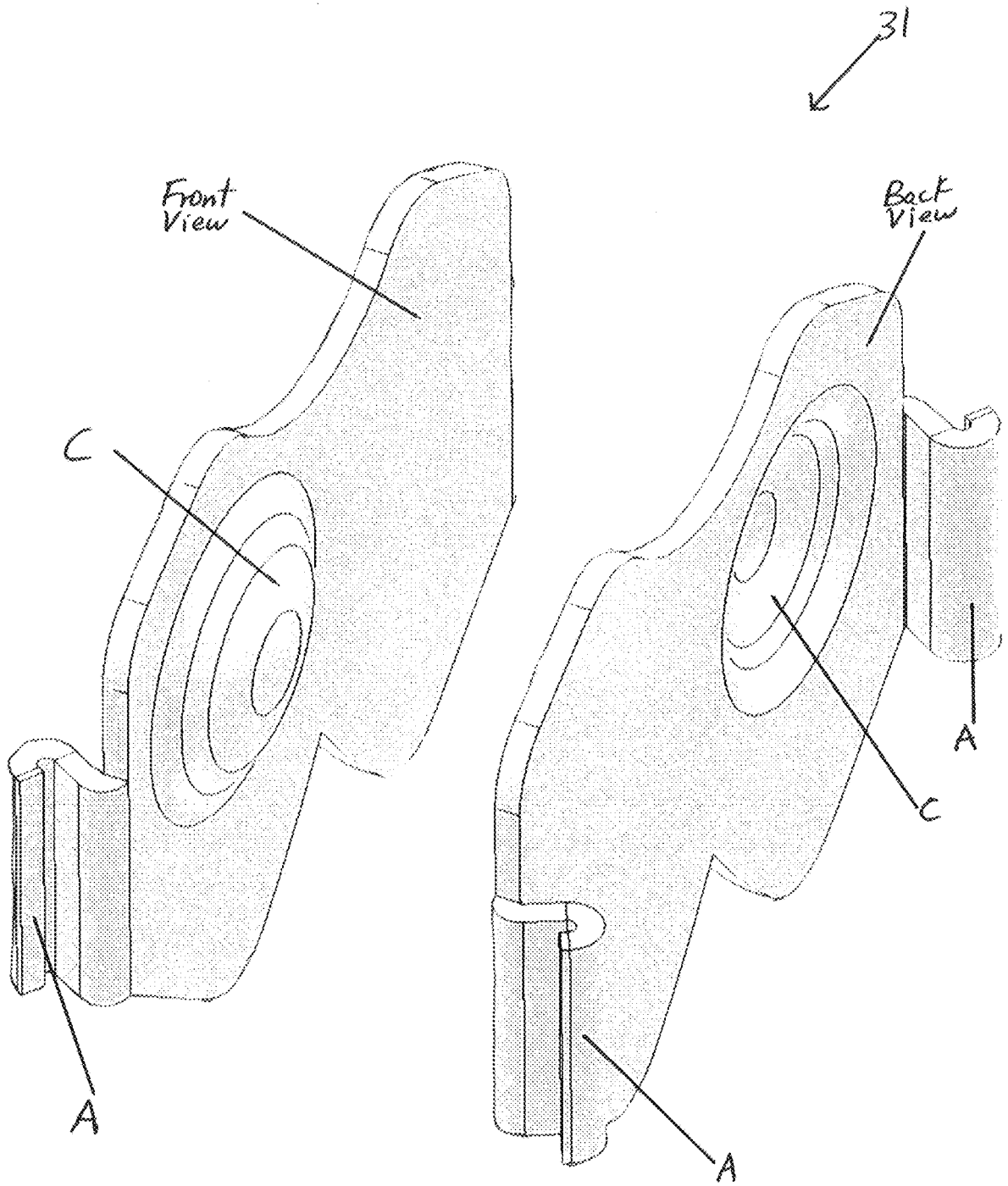
FIG. 12 is an illustration of an example spring clip or tension clip as shown in FIG. 1.
Figure 12A:
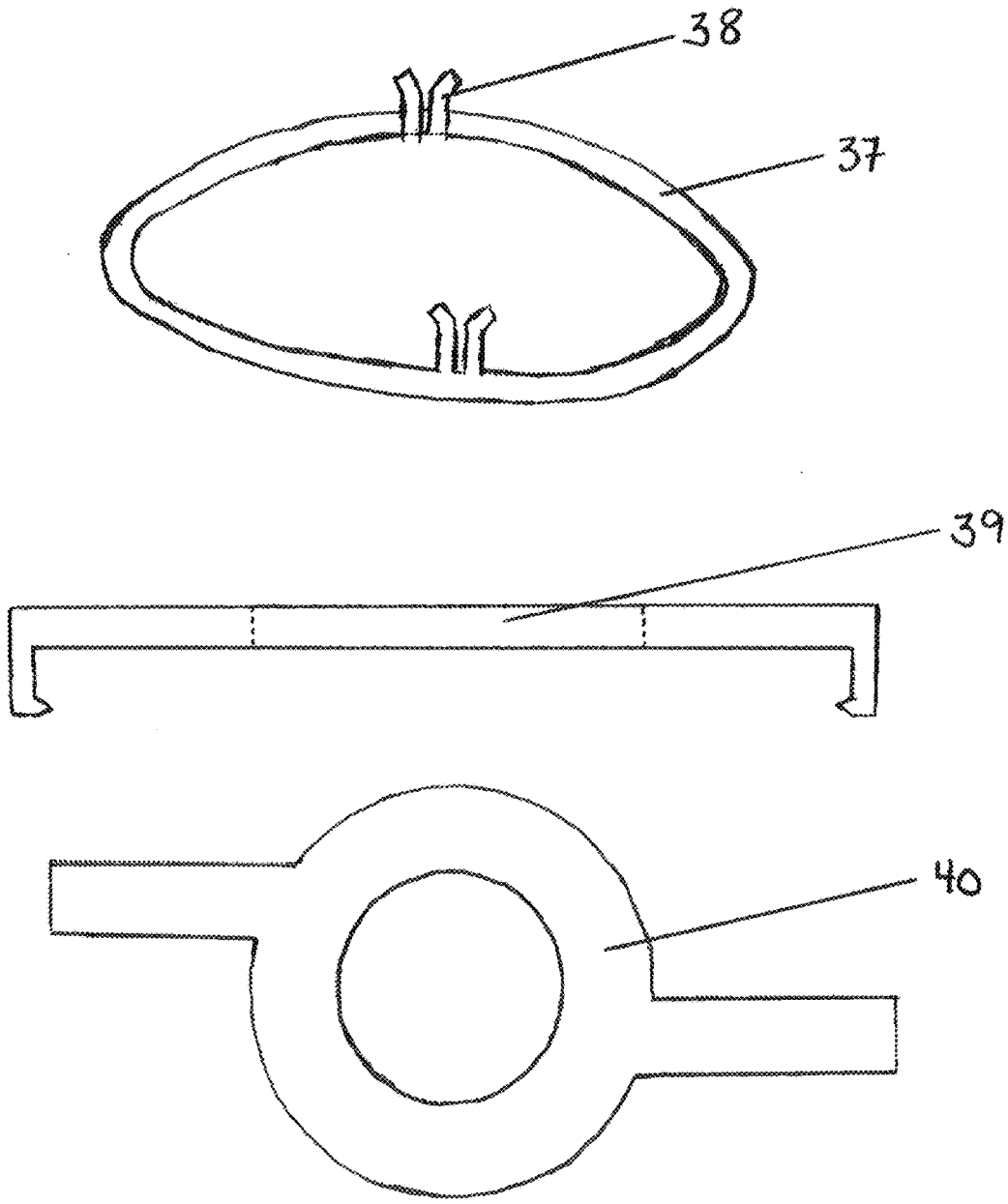
FIG. 12AA is an angled view illustration of the example spring clip of FIG. 12 in place on the housing body.
Figure 12A:
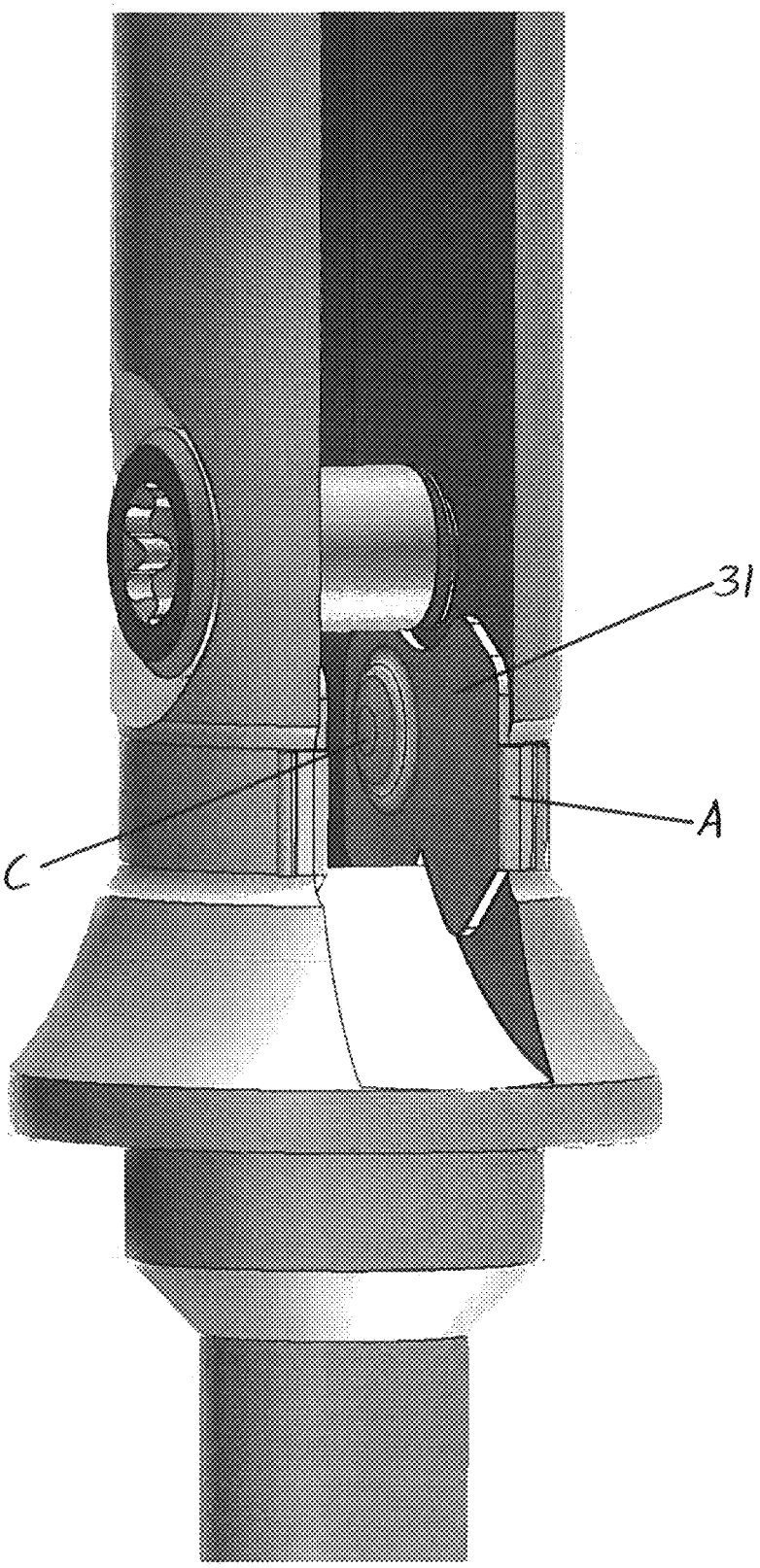

In FIG. 12 is an illustration of tension clip 31 that holds blades 6 and 7 (not shown in this drawing) in the retracted in-flight position 10. In this illustration, tension clip 31 has two outer portions (A) that hook onto housing body 2 (as shown in FIG. 12AA). Tension clip 31 has a bump-out portion (C) that can push against blade 6 or 7 holding blades in an in-flight retracted position. It should be noted that tension clip 31 can also attach to blade 6 or 7 and push or press against housing body 2 to hold blades in a retracted in-flight position. Bump-out portion (C) can also hook or lock into cut-out portion 35, 36 in blade 6 or 7 (shown in FIG. 15), to hold blades in a retracted position. It should be noted that the blade retention devices can be a bump-out, dome-shaped portion, extrusion, spring in blade, cut-out within blade, compressed angle spring, steel ring, plastic or carbon clip, o-ring, rubber band ring, half ring, spring ring, tension ring, tension ring pushing on blades, tension ring covering blades, tension ring pulling blades inward, tension wire, tension wire pulling on blade extrusions and keeping blades retracted, plastic clip, tension wire or spring washer pushing against the blades, torsional spring or tension clip over any portion of the blades or housing body or pressing against the blades, or housing body of any size, shape, or combinations thereof.

FIG. 12A illustrates different embodiments of blade retention devices that can be used in the current invention. Blade retention device 37 has extending tabs 38 that hold or press the blades to retain them in a retracted in-flight position. Extending tabs 38 can be angled upward (perpendicular) or outward more (parallel) to retention device 37. Blade retention spring clip 39 hooks into or against blades 6, 7, or blade extensions 13 and 14 to keep the blades in a retracted in-flight position. In an alternative embodiment, blade retention device 37 can have spring clip portion attached to a blade to hold the blade in a retracted in-flight position. These blade retention devices 37, 39, and 40 can also be various shapes and sizes and angles, wire clip, metal clip, flat member, angled member, cut in blade, and combinations thereof.

Figure 12B:
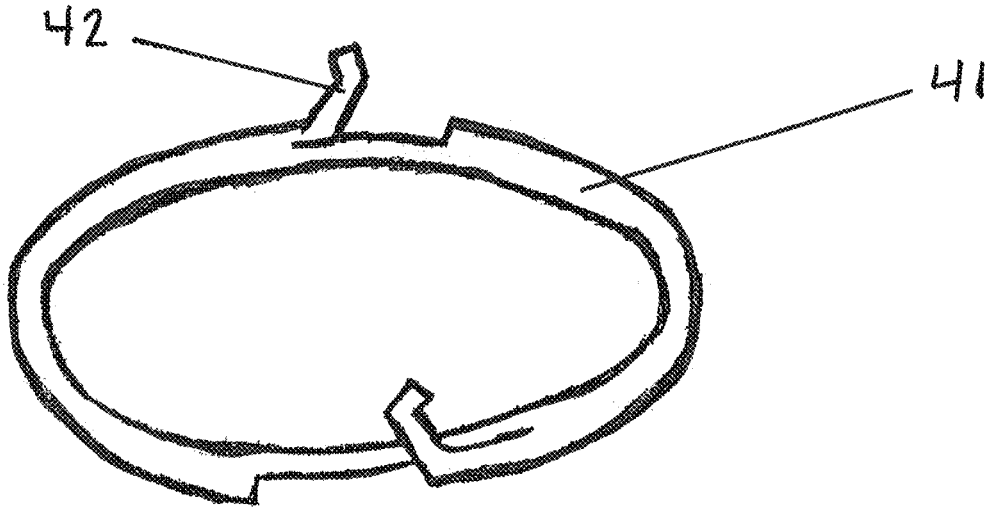
FIG. 12B is yet another example of a blade retention device that holds or attaches the blades to a cross member or pin screw to hold them in a retracted in-flight position.
Figure 12C:
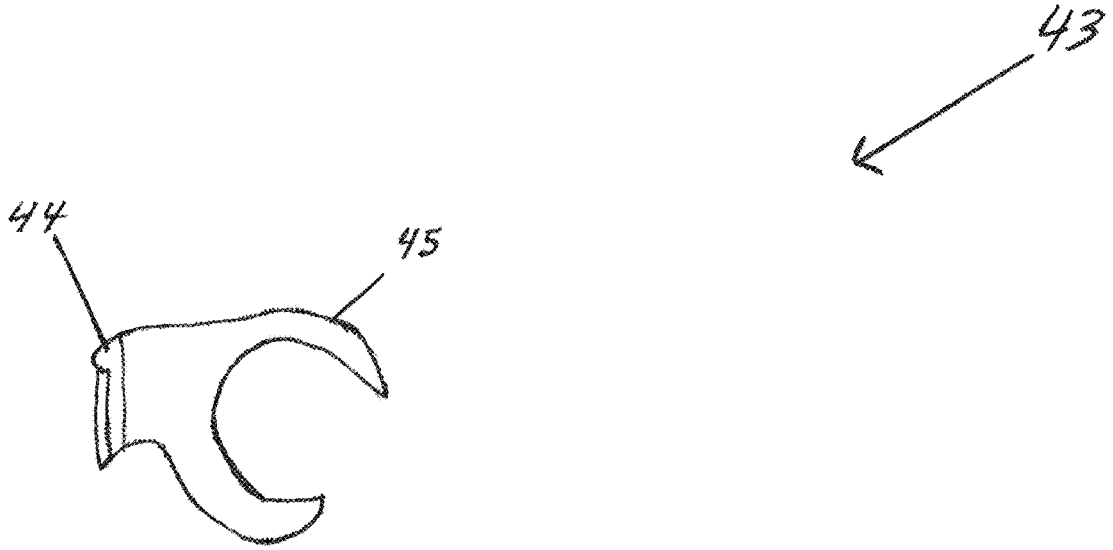
FIG. 12C is yet another example of a blade retention device that can attach to the blade and also snap or attach to a pin screw, housing body, or extension or cross member.
Figure 12D:
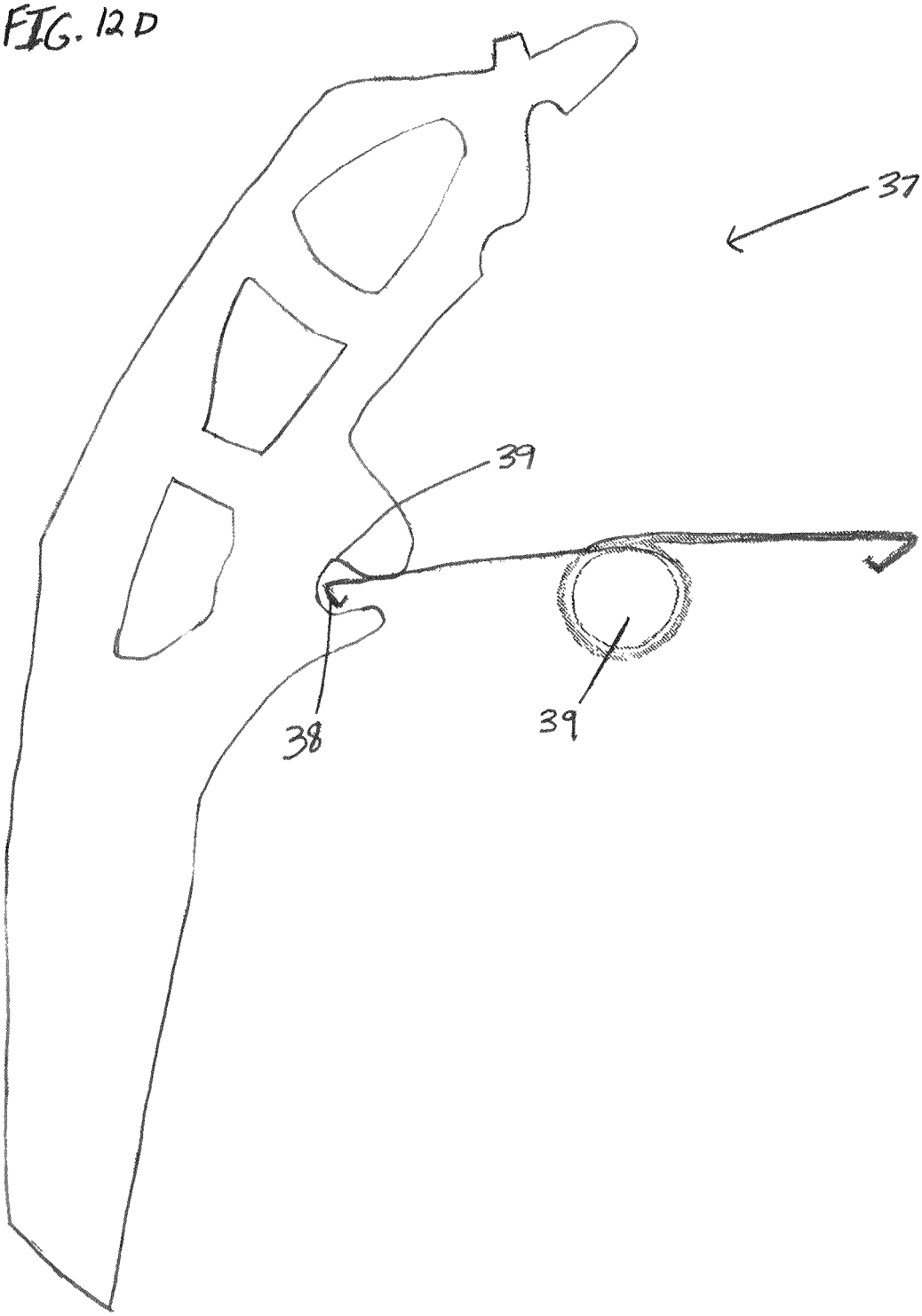
FIG. 12D is yet another example of a blade retention device with blade coupling member to hold the blades in an in-flight position.
Figure 12E:
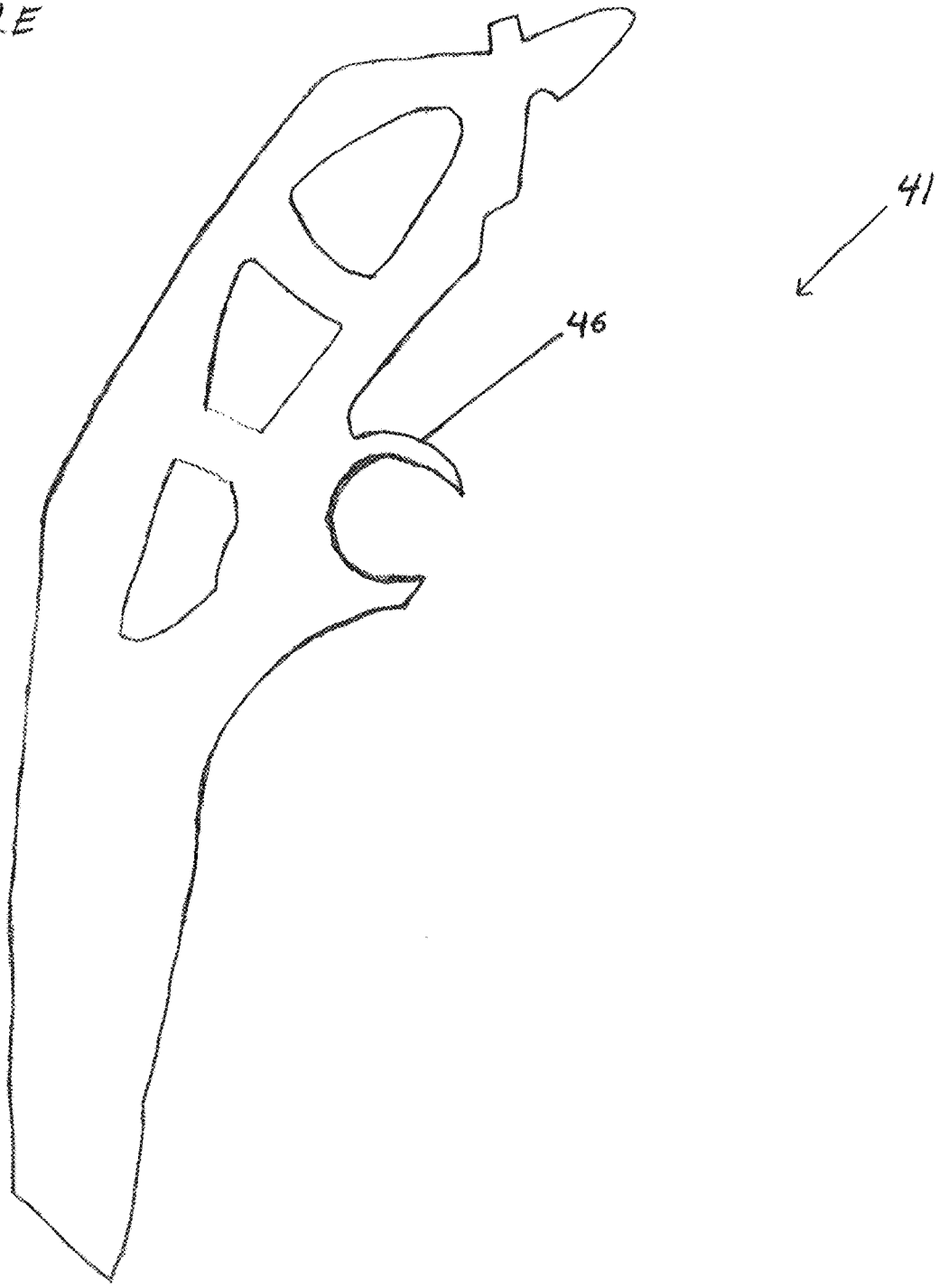
FIG. 12E is another blade retention device with spring tension on the blade that can snap on, hook over or against the housing body, cross member, screw pin, etc. It should be noted that the spring tension in or on this blade can also pry against a cross member, screw pin, or between the cross member, screw pin, housing body, or inner groove of the housing body.

FIG. 12B is another embodiment of a blade retention device 41 that has an extending tab 42 that can be used to hook or press against or over a blade to hold in a retracted in-flight position. Extending tab 42 can be angled upward (perpendicular) or outward more parallel to retention device 41. Extending tab 42 can also push against screw pin 4 and lower portion 24 of elongated groove 21 in housing body 2. It should also be noted that there are other ways to hold the blades together while still coming within the scope of the current disclosure. FIG. 12C is another embodiment of a blade retention device 43 that attaches to a blade with clip attachment 44. The extended tab 45 can snap over or against screw pin 4 (not shown in this drawing). The extension tab 45 can also snap or press over or against overlapping blade to hold the blade in a retracted in-flight position. FIG. 12D illustrates a blade retention device 37 that has a circular portion 39 that couples to screw pin 4 (not shown in this drawing). FIG. 12E illustrates a blade retention device 41. The blade cut-out portion 46 snaps over or against screw pin 4 (not shown in this drawing).

It should also be noted that these blade retention devices can be made with rubber, plastic, metal, carbon, or any material to form a shape or blade retaining device. From the above discussion of different types of cutting blade retention devices, it can be appreciated that other examples of a spring clip, tension clip, bump-out, blade spring blade cut-out, rings, banding, washers, clips, combinations and similar retracting devices can be used equally well for holding the cutting blades in the retracted position during arrow flight and prior to target contact.

It should be mentioned that the various blade retention means shown in the drawings for holding the cutting blades in a retracted position during arrow flight can be used equally well for other embodiments of the broadhead disclosed herein.

Figure 13:
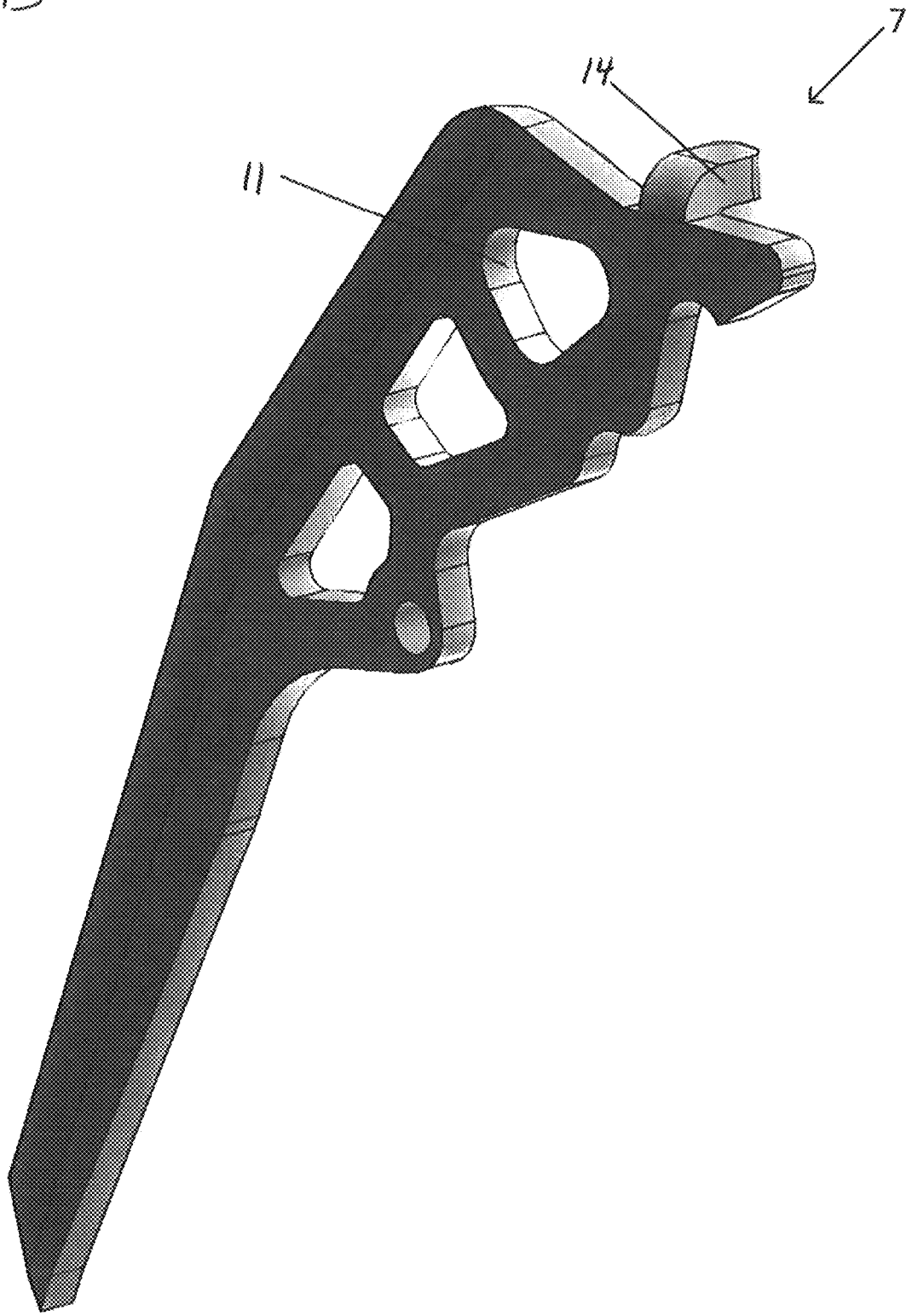
FIG. 13 is an angled view illustration of an example of a blade with blade extensions and receiving slot.

FIG. 13 is an illustration of blade 7 with a blade extension 14 and receiving slot 11. The blade extension 14 is on the opposite side of the blade face that couples against blade 6. In this illustration, the blade extension 14 can be used to slide on an outer portion of the housing body 2 and the blade coupling member 15 can be used to be received in a portion of the other blade receiving slot 11*a* that are both received in the housing body 2 (not shown in this drawing). It should be noted that there can be multiple blade extensions or blade slots on each blade and in different locations or different shapes and sizes.

Figure 14:
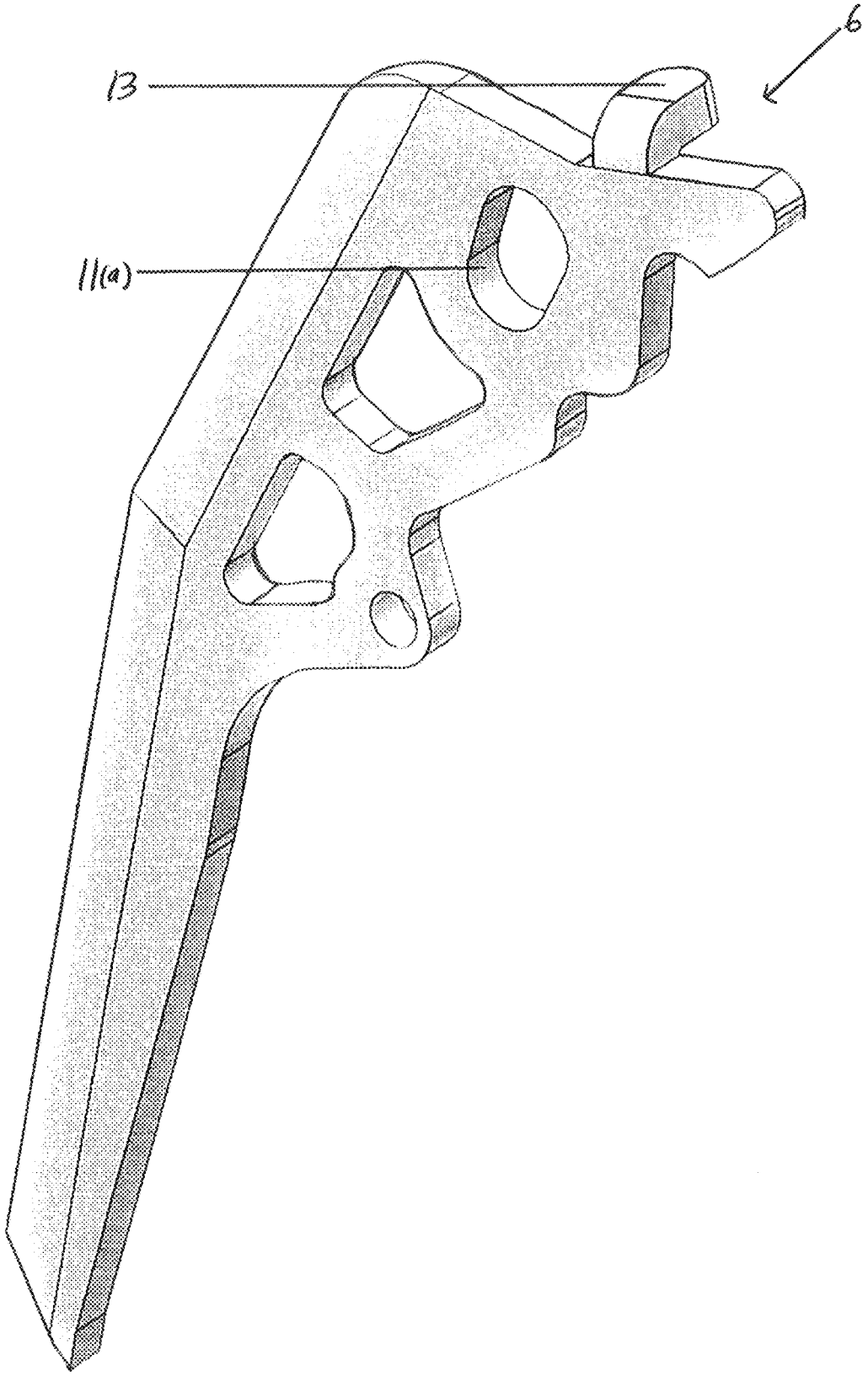
FIG. 14 is an angled view illustration of an opposite blade that also has a blade extension in another direction, and an elongated groove or cut-out portion in the blade for the other blade member and spring clips to be received.

FIG. 14 is an illustration of blade 6 with a blade extension 13 and a receiving slot or elongated groove 11 (*a*). This elongated groove is used to receive the blade coupling member 15 (not shown in this drawing) to contain the blades within the housing body 2. Elongated groove 11 and 11 (*a*) can also be an open groove or open contour and they can also be a closed groove or slot of any shape or size. Blade 6 can also have multiple blade extensions and eliminate the receiving slot 11*a*, yet still be received in the elongated groove 21 of housing body 2.

Figure 15:
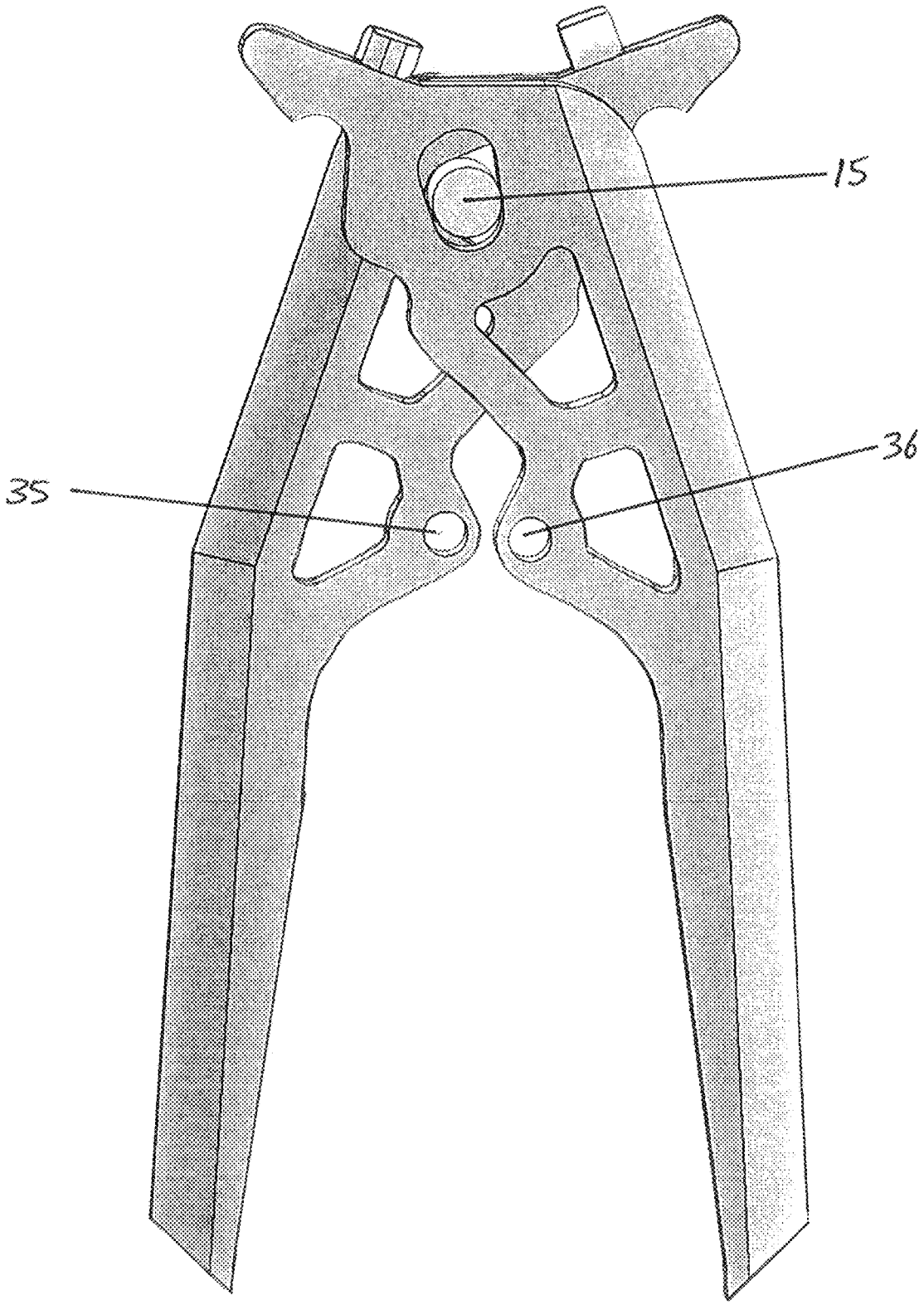
FIG. 15 is another illustration of a two-blade configuration that has multiple blade extensions shown in a retracted in-flight position.

FIG. 15 is an illustration of another two-blade configuration with an elongated groove portion or aperture 35 and 36 in a retracted in-flight position. In this configuration, the elongated groove portions 35 and/or 36 can receive bump-out portion C of spring blade retention clip 31 (FIG. 12). In this view, the blades 6 and 7 are shown in a retracted in-flight position. It should be noted that blade coupling member 15 can also be any shape or size and can also be a loose within one or more apertures and does not necessarily have to be connected to either blade but is still contained within receiving slot 11 (*a*). In some embodiments, blade coupling member 15 can also couple at least one blade within an elongated groove 21 of housing body 2. It should be noted that multiple blade extensions and configurations can be used on different embodiments to receive the blades to or within other housing bodies and embodiments.

Figure 16:
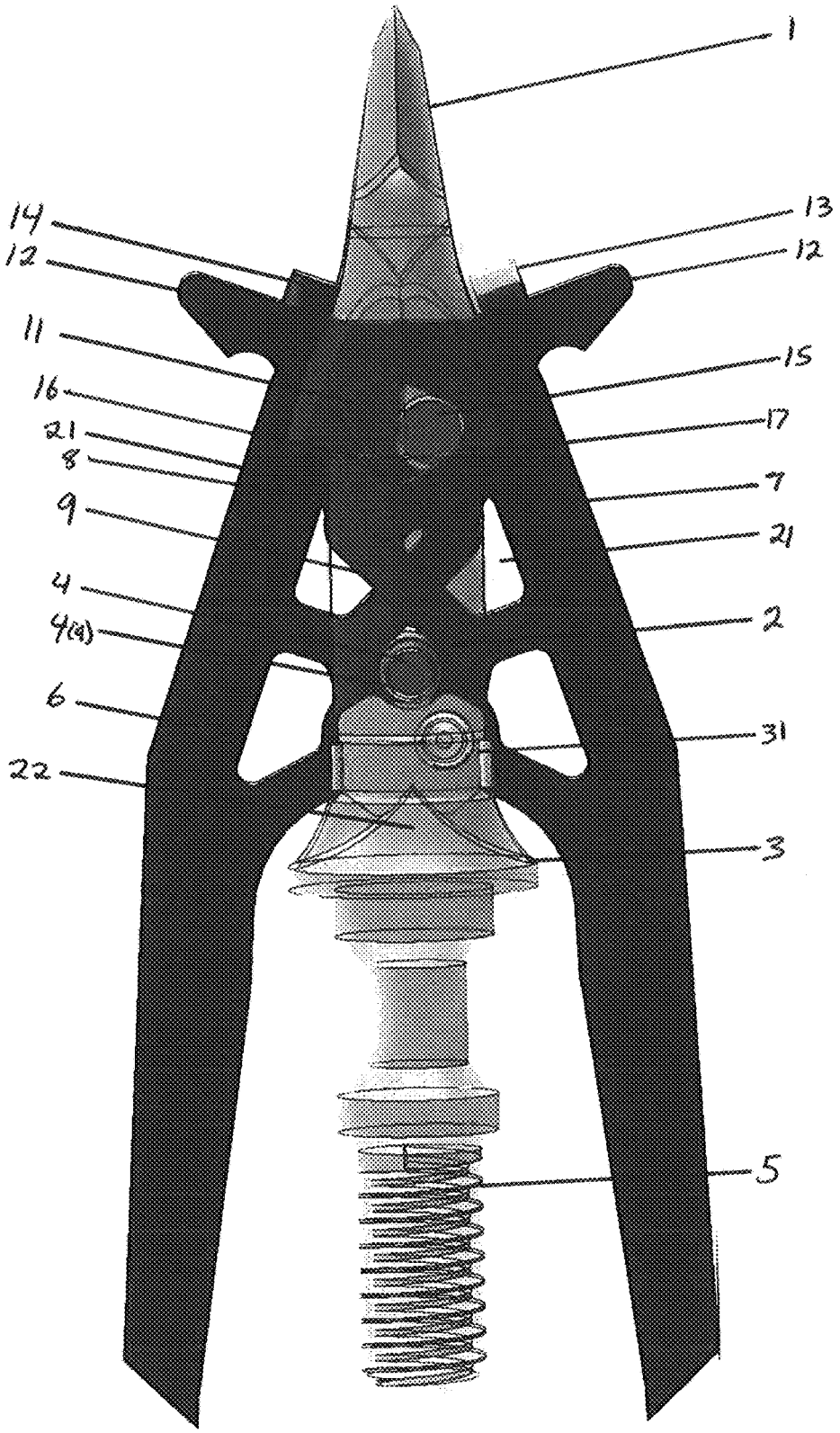
FIG. 16 is a rear view of an arrow broadhead with a pair of cutting blades received inside an elongated groove in the housing body, according to an exemplary embodiment. The blades are in the retracted in-flight position and the blade extensions are extending in opposite directions (one extending into the page and one extending toward the viewer).

In FIG. 16 is a front view of an embodiment showing a retention clip 31 holding blades 6 and 7 in a retracted in-flight position. It should be noted that blade retention devices can be at various locations on the housing body or blades to hold them in the retracted in-flight position. The retention clip can be on the outside, inside, or any other location on the blades or housing body for holding them in a retracted position. In this view, blade 7 is overlapping blade 6 in the elongated groove 21 of housing body 2. This view also illustrates how blade extension 13 and blade extension 14 are extending outward in opposite directions and on opposite sides of the housing body 2 (extension 13 extending in a direction into the page and extension 14 extending in a direction away from the page). These blade extensions going in opposing directions couple blades 6 and 7 within elongated groove 21 and do not interfere with blades 6 and 7 crossing over one another within elongated groove 21. The blade extensions 13 and 14 also help blades slide rearward and align blades while moving from a retracted in-flight position to an expanded cutting position. The blade extensions also lock the blades into an expanded position by pressing against the housing body 2. The blade extensions can further lock the blades into an expanded position by hooking or pressing against the portion 16 and 17 of housing body 2 and pressing against screw pin 4 or housing body 2. It should be noted that retention clip 31 can be on the outside portion of blade 6 and 7 or can be clipped over or to blade extensions 13 and 14, pulling blades 6 and 7 inward to keep them in a retracted in-flight position. It should also be noted that retention clip 31 can also be coupled or attached to blade 6 or 7 to press against blades or body to keep or hold the blades in a retracted in-flight position.

Figure 17:
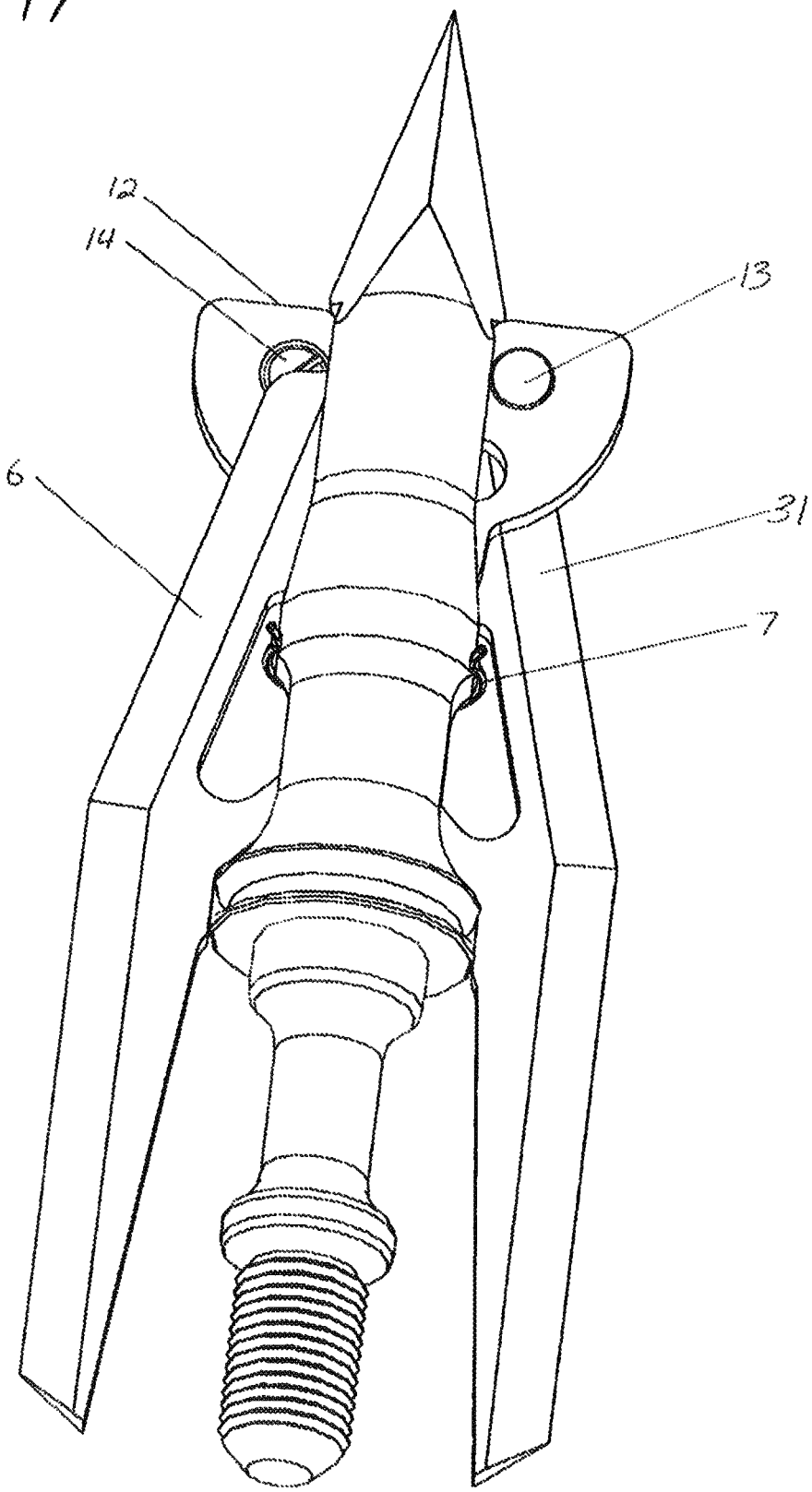
FIG. 17 is an illustration of an angled view of the housing body with a retention clip in the middle portion of the housing body holding the blades in a retracted, in-flight position. This view illustrates the blade extensions on opposite sides and in opposite directions and illustrates how the blade extensions may keep the blades in the elongated grooves.

In FIG. 17 is another angled view with blade extensions 13 and 14 that are screwed into blade portion and are also in opposing directions. Blades 6 and 7 can still move or rotate freely without interference of blade extensions 13 and 14.

Figure 18:
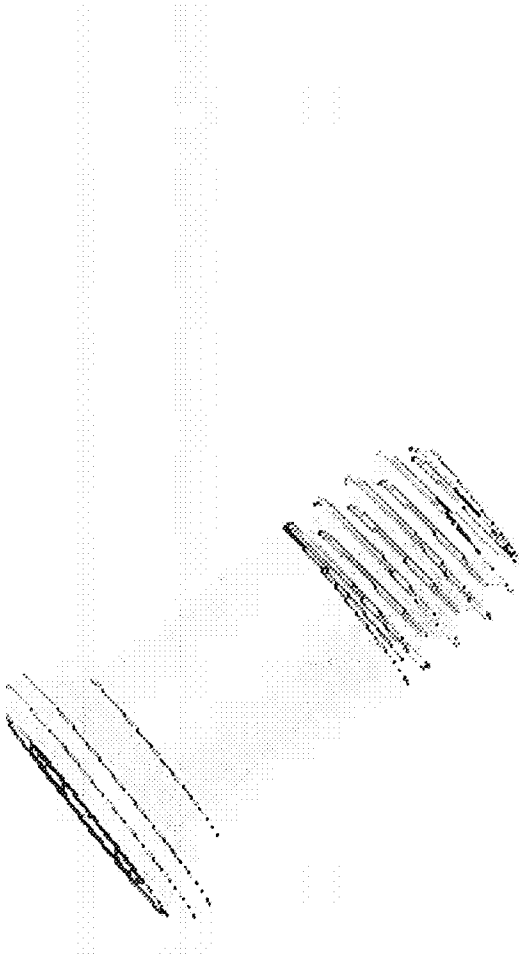
FIG. 18 is a cross member or screw pin that extends through an elongated groove.

In FIG. 18 is an illustration of a screw pin or cross member 4 that goes through elongated groove 21 of housing body 2 (not shown in this drawing). This screw pin or cross member can be used to prevent blade coupling member 15 from being released from housing body 2 (not shown in this drawing). Also, the screw pin or cross member can also be used to help blades 6 and 7 lock into an expanded position. It should be noted that the screw pin or cross member can be located in various locations on or in housing body 2 and can be any shape, size, or material.

Figure 19:
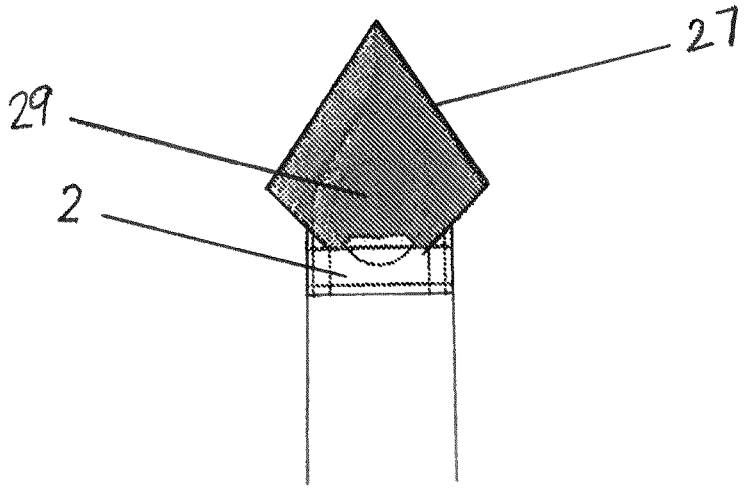
FIG. 19 is a view of a bladed tip that may be attached to the housing body.

In FIG. 19 is yet another embodiment of a bladed tip 27 coupled to housing body 2 with a screw pin 29. With this configuration, the blades 6 and 7 can be removed through housing body 2 (not shown in this drawing) by taking out bladed tip 27 and sliding coupled blades into the elongated groove 21 from the top portion of housing body 2. This bladed tip 27 can also be detachable, yet not a portion of the elongated groove 21 of housing body 2 (not shown in this drawing). The bladed tip 27 can be in a top portion of the housing body 2 and not be received in the elongated groove 21 but separate from that groove (not shown in this drawing).

Figure 20:
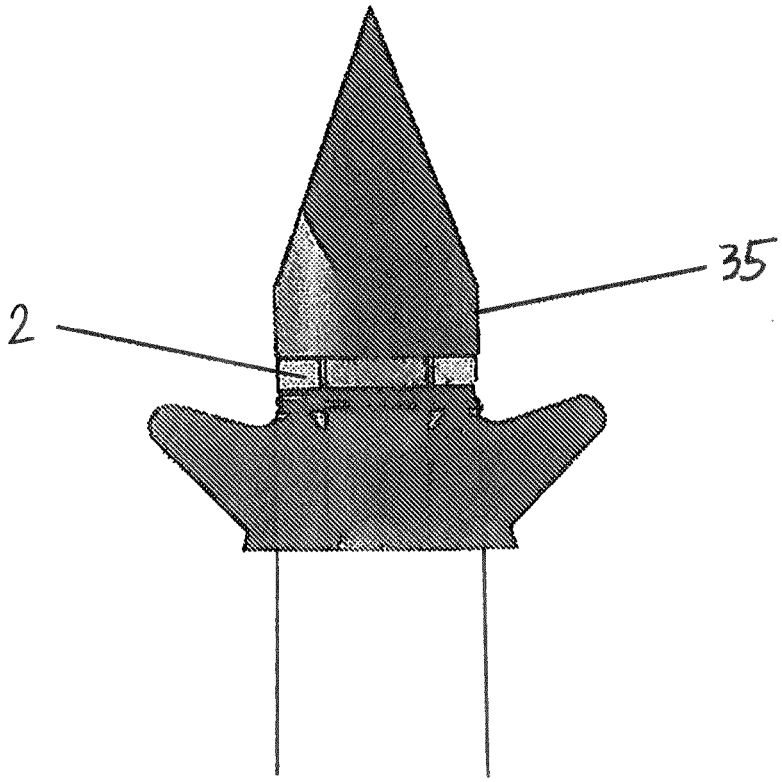
FIG. 20 is a view of another detachable tip that may be attached to the housing body. With a detachable tip, it allows the blades to be removed from the body while still being coupled together.

In FIG. 20 is another embodiment illustrating a removable tip 35 that can be coupled to housing body 2 with threads, glue, press fit, or any other means of securing a tip to housing body 2.

Figure 21:
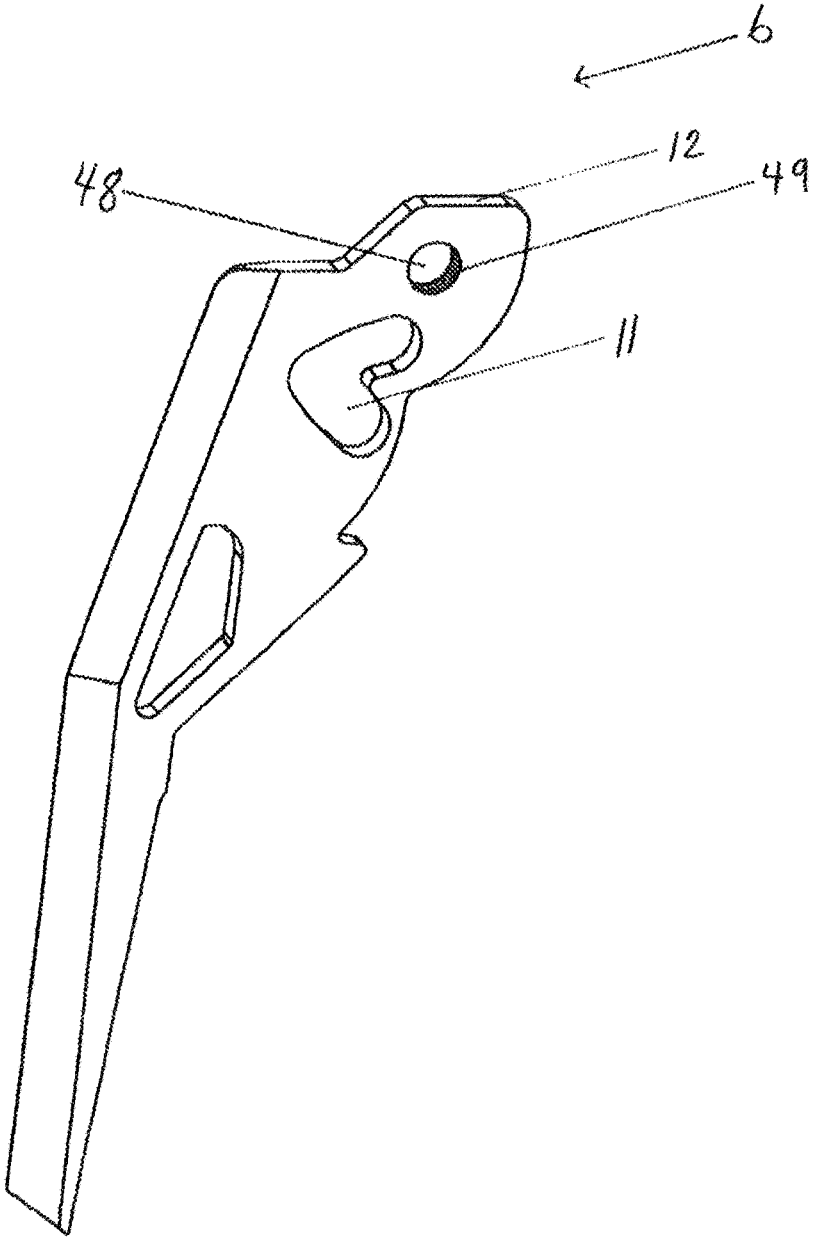
FIG. 21 is another view of an example first blade (as shown in FIG. 8) with threaded holes for receiving a blade extension.

In FIG. 21 is an angled view of another blade embodiment, showing an opening 48 and a threaded portion 49 for a blade extension to be coupled to blade 6. This embodiment allows another blade extension member to be detachable and can allow blades 6 and 7 to be detached from housing body 2.

Figure 22:
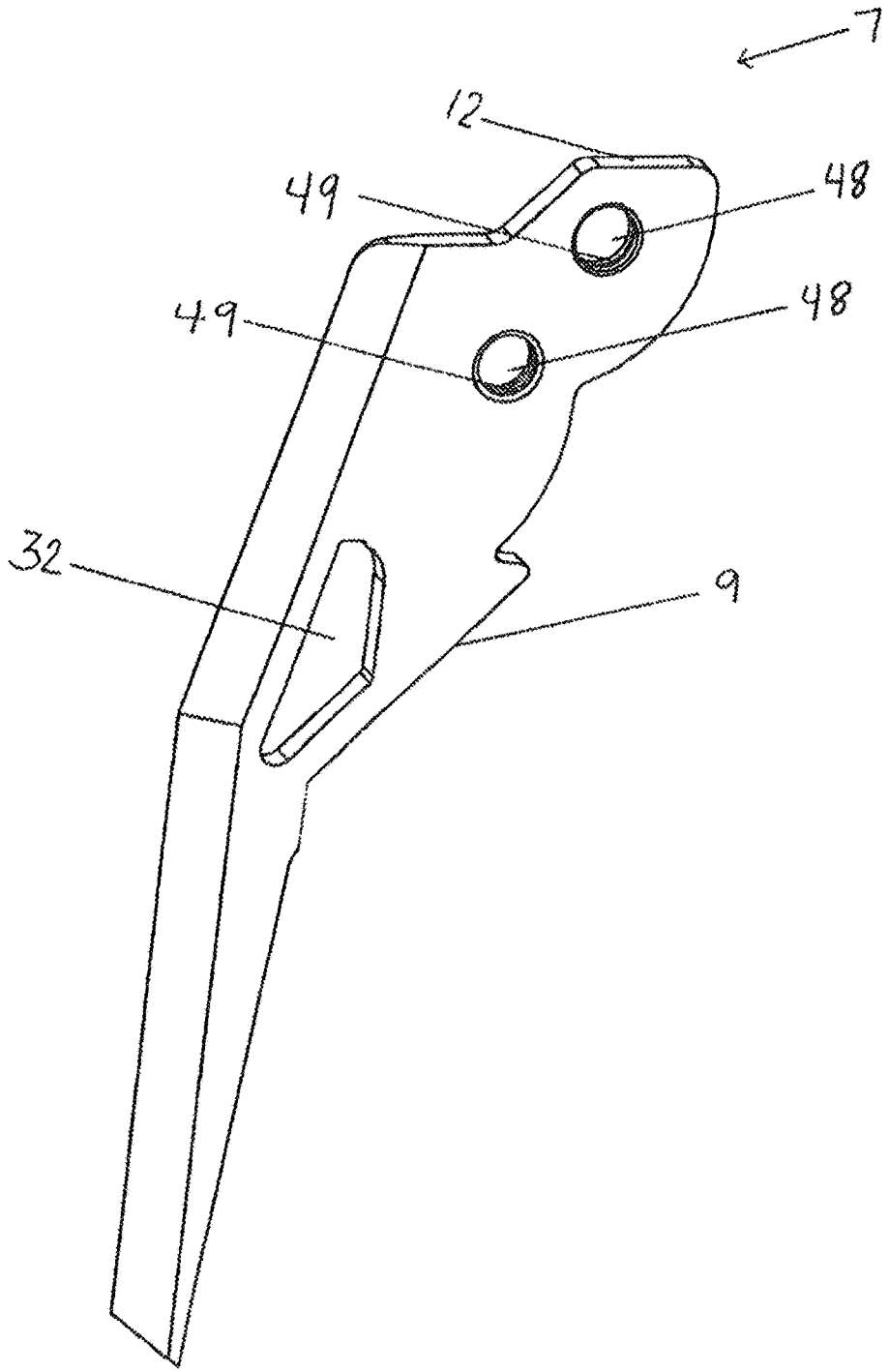
FIG. 22 is another view of an example second blade (as shown in FIG. 7) with threaded holes for receiving blade extensions.

In FIG. 22 is another angled view of a blade embodiment showing a plurality of openings 48 and threaded portions 49 for other blade extensions to be coupled to blade 7. This embodiment allows for a blade extension and a blade member to be detachable and can allow blades 6 and 7 to be removed from elongated groove 21 of housing body 2. It should also be noted that there are other ways to couple blade extensions to blade 7 by utilizing a pin, press-fit pin, glued pin, nut and flat bolt, welded portion, bent portion, bump-out, composite, molded extension, bend in blade, widened portion of blade, forged extension, or other means for blade extensions or for coupling blade extensions. It should be noted that blade extension 13, 14, can be of various shapes, sizes, addition, protruding portion, screw, nut or bolt, bend, rivet, pin, extrusion, removable, permanent, or any combination thereof.

Figure 23:
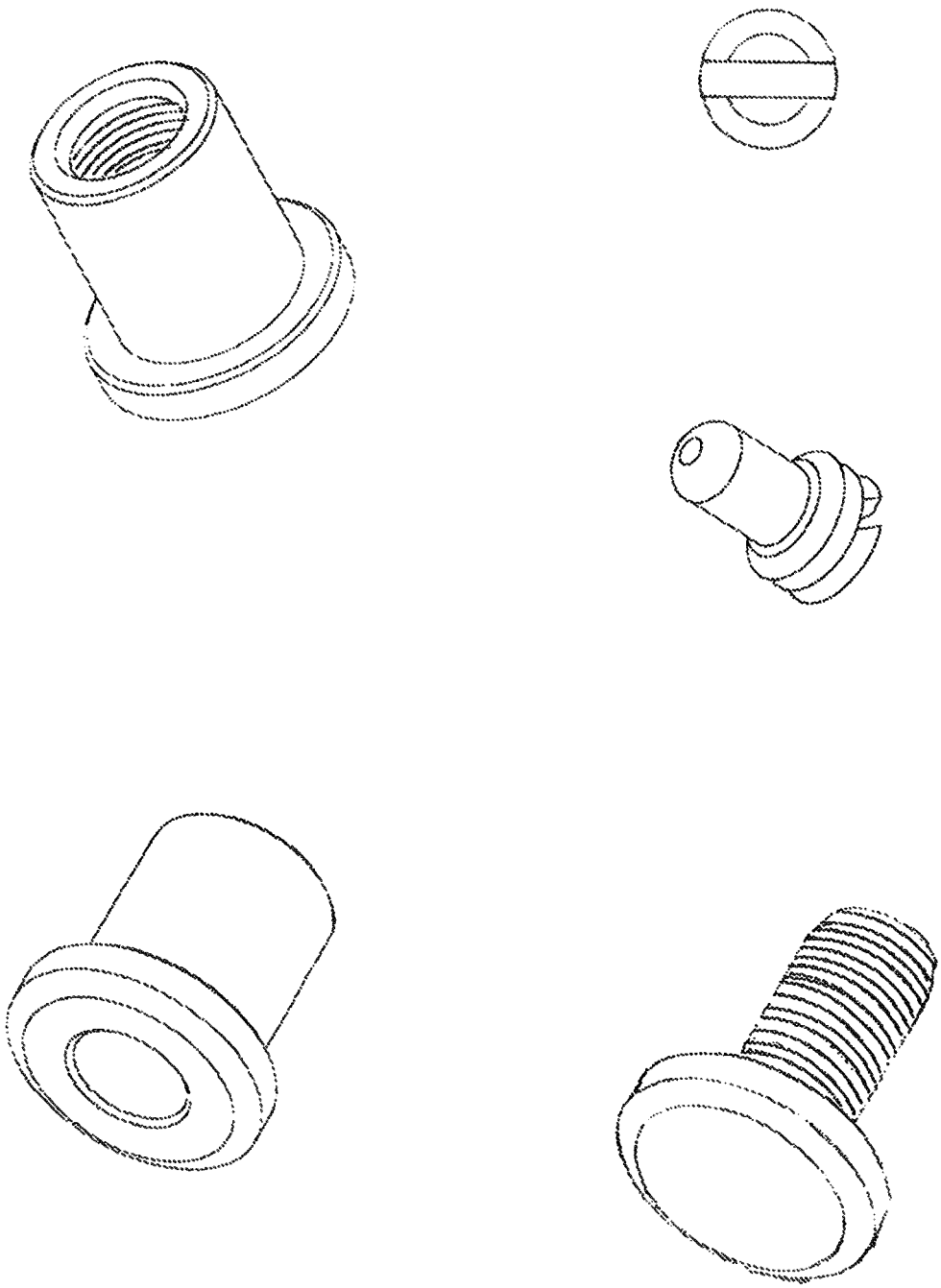
FIG. 23 is an illustration of further examples of various blade extensions and blade coupling devices or cross members.

In FIG. 23 are yet more illustrations of blade extensions or blade coupling members, according to alternative embodiments.

Figure 24:
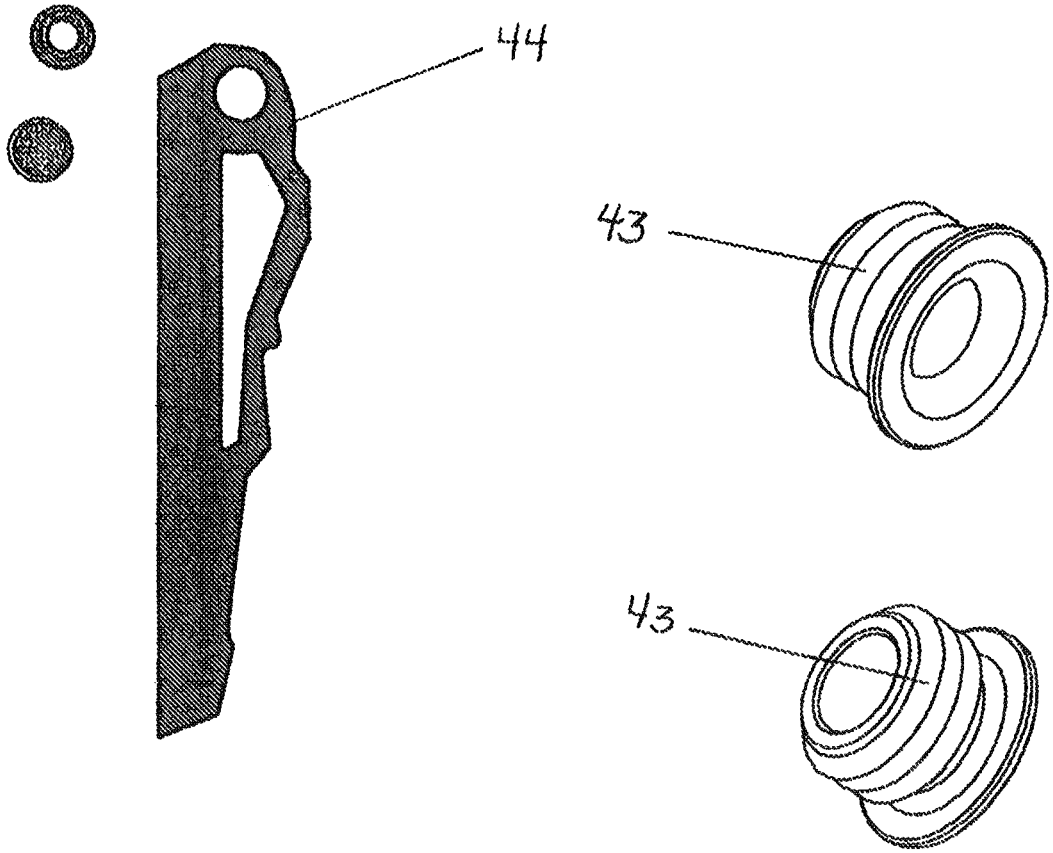
FIG. 24 are more examples of a blade extension or blade coupling device and another blade.

In FIG. 24 is yet another illustration of a blade coupling or blade extension device 43 and another blade example 44.

Figure 25:
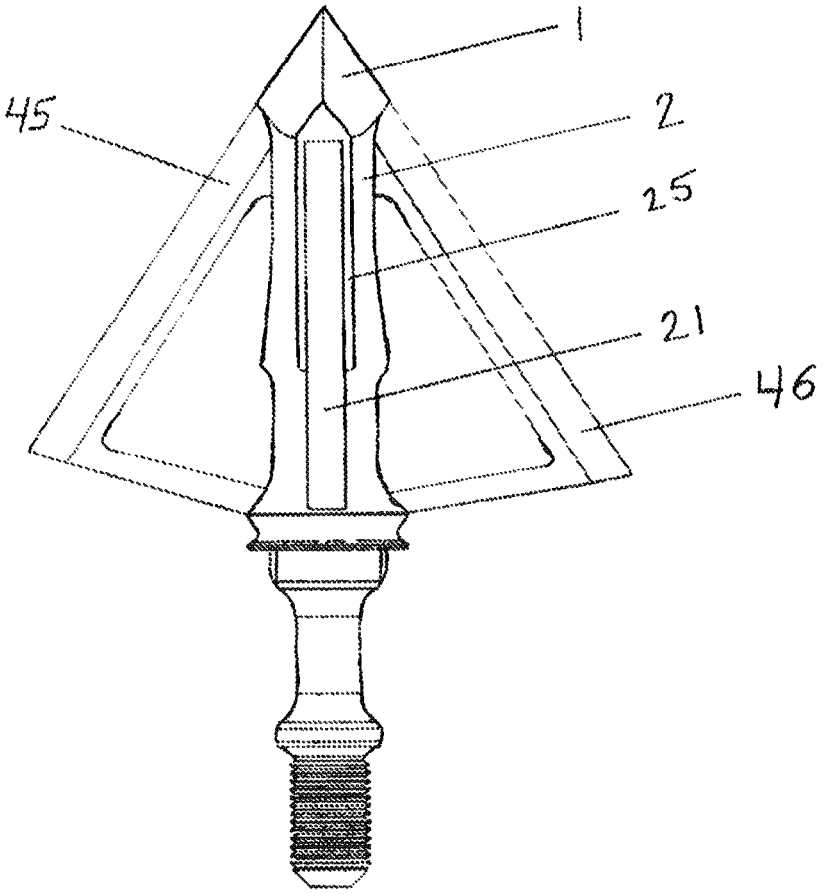
FIG. 25 is another embodiment with a housing body having additional blades that are coupled to the side while still having an elongated groove to receive additional blades.

In FIG. 25 is an embodiment with additional blades 45 and 46 that are attached to housing body 2. This illustration also shows how there can be blades 6 and 7 (not shown in this drawing) within the elongated groove 21 while still having additional cutting blades in housing body 2. It should be noted that the blades can also extend into or over the top portion of housing body 2 or over the tip 1.

In some embodiments, an arrow broadhead may comprise a housing body having an elongated groove extending through a portion of the housing body and a first and a second cutting blade extended through the elongated groove. The first and second cutting blades have at least one extension that contains the blades to the housing body. In still other embodiments at least one blade has a slot, hole, cut-out, radius, groove, divot inset portion of any size, shape, or configuration that contacts a blade spring clip to retain the blades in a retracted in-flight position. In still other embodiments the blades move rearward at impact and drop into slot or press over pin screw, body, or attachment to lock blades into an open expanded cutting position. Still other embodiments comprise a non-parallel portion or widened extension of at least one blade pries against a portion of the body to lock the blades into an open expanded cutting position. Still other embodiments have a movable blade member or element within at least one blade that couples to another blade, along with at least one blade extension that couples blades to housing body. Still other embodiments have a movable blade coupling member that is received within a blade slot or groove that couples the blades together. The coupled blades can also be contained within the elongated groove in housing body, with the blade extensions or combination thereof. The broadhead may further comprise at least one extension on at least one blade that slides and rotates on an outside portion of the housing body. The broadhead may further comprise an angled slope on the outside portion of the housing body, wherein the blade extension slides over and locks the blades into an extended cutting position. The first and second cutting blades may be coupled together yet configured to move independently of each other. The broadhead may further comprise a blade retention device holding the first and second cutting blades in a retracted position during arrow flight. The blade retention device may comprise a tension clip. The tension clip may be configured to hook or press on the blades holding them in a retracted in-flight position. In still other embodiments, the blade retention device can be attached to at least one blade and push against the blade or body to hold blades in a retracted in-flight position. In still other embodiments, the tension clip for blade retention can be held by a fastener, snapped on, bent clip, pressed, or any other method to attach to body or at least one blade or extension. In still other embodiments, the blade retention device can push blades forward or rearward to lock against the body, elongated groove, tip, blade, extension, pin, fastener or blade coupling member. The broadhead may further comprise an elongated groove in at least one cutting blade and a blade member configured to couple the blades within the elongated groove in the housing body. The broadhead may further comprise a notched-out or thinned portion on at least one cutting blade that creates a binding or spring in blade that locks on a portion of the housing body to keep the blades in a locked expanded cutting position. The broadhead may further compromise a blade extension on at least one blade that locks under a portion of the housing body to keep blades in a locked expanded cutting position.

In some embodiments, the blade extension may pry and press against the outer portion of the housing body, locking the blades in an expanded cutting position. In some embodiments, the housing body has an opening to insert blade coupling member. In some embodiments, the opening in the housing body may have a screw, cap, pin, or any member to cover the opening to prevent blade coupling member from coming out of housing body. In some embodiments the opening in the housing body may also have a pin, screw, or any member that goes through at least one blade or through the elongated portion and presses against or hooks over or pries against a portion to lock blades into an open, expanded cutting position. In some embodiments the housing body may have an elongated groove that extends through forward tip portion, to allow coupled blades to be inserted in housing body with a tip that can be detachable or added after broadhead assembly. In some embodiments the blade extension may be a wider or flared portion where the coupled blades are inserted into the elongated groove in housing body and then insert pin or cross member through elongated groove to keep blades coupled to housing body. In some embodiments the housing body may also have an extended or widened portion for blade extensions to hook under or against to lock blades into the open expanded cutting position.

In some embodiments, a broadhead may comprise a blade retention device that presses against the blades keeping them in a retracted in-flight position.

The arrangements of the broadheads, as shown, are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited herein. Accordingly, all such modifications are intended to be included within the scope of the present disclosure as described herein. The order sequence of any process or method steps may be varied or re-sequenced according to alternative embodiments. Other substitutions, modifications, changes, and/or omissions may be made in the design, operating conditions and arrangement of the preferred and other exemplary embodiments without departing from the scope of the present disclosure as expressed herein. It should also be understood that changes in the embodiments to the disclosed invention are meant to be included as coming within the scope of the claims.

What is claimed is:

1. A broadhead comprising:

at least two overlapping blades received within an elongated groove of a body, each blade coupled together with a free-floating movable member, wherein the free-floating movable member is configured to move freely within the elongated groove of the body, wherein at least one of the overlapping blades comprises a second elongated groove for receiving the free-floating movable member, and wherein the free-floating movable member is movable in a horizontal direction and a vertical direction relative to the body.

2. The broadhead described in claim 1, wherein the free-floating movable member is configured to move freely within the second elongated groove within the at least one of the overlapping blades.

3. The broadhead described in claim 1, wherein the at least two overlapping blades are held in a retracted position by a blade retaining device.

4. The broadhead described in claim 3, wherein the blade retaining device comprises a tension clip.

5. The broadhead described in claim 1, further comprising at least one blade extension that couples the at least two overlapping blades within the elongated groove.

6. The broadhead described in claim 1, further comprising a notch portion of at least one of the at least two overlapping blades that locks on a portion of the body or a cross member to lock the at least two overlapping blades into an expanded cutting position.

7. The broadhead described in claim 1, wherein at least one blade extension on at least one of the overlapping blades pushes against a portion of the body to lock the respective blade into an expanded cutting position.

8. The broadhead of claim 1, further comprising at least one spring member being a portion of the at least two overlapping blades that pries against a cross member and/or the body.

9. A broadhead adapted for moving from a retracted position during arrow flight to an expanded position when contacting a target, the broadhead comprising:

a housing body having an elongated groove extended through at least a portion of the housing body;

a first cutting blade and a second cutting blade disposed at least partially within the elongated groove and each of the first and second cutting blades having an extension on at least one portion of the respective blade;

the first and second cutting blades coupled to be received within the elongated groove;

wherein the first and second cutting blades are configured to move and pivot within the elongated groove and are held by at least one of the extensions against the housing body whereby respective extension hooks over a portion of the housing body, holding the respective cutting blade in an expanded, locked cutting position, wherein each extension can be any portion of or extension to the respective cutting blade that is non-parallel to a major surface of the respective cutting blade, wherein at least one of the extensions on the first and second cutting blades slides on an outside surface of the housing body, and wherein the first and second cutting blades are coupled to the housing body by a free-floating movable member, the free-floating movable member being movable in a horizontal direction and a vertical direction relative to the housing body.

10. The broadhead as described in claim 9, wherein the first and second cutting blades overlap one another and are coupled together within the elongated groove.

11. The broadhead as described in claim 9, wherein the first and second cutting blades extend outside the housing body through the elongated groove.

12. The broadhead as described in claim 9, wherein each of the extensions locks into the housing body holding the first and second cutting blades into an expanded cutting position.

13. The broadhead as described in claim 9, further including a removable tip.

14. The broadhead as described in claim 9, wherein a blade retaining device pushes against a portion of the first and second cutting blades.

15. The broadhead as described in claim 9, further comprising at least one fixed blade coupled to the housing body.

16. The broadhead as described in claim 9, wherein the free-floating movable member is movable in the elongated groove.

17. A broadhead comprising:

a housing body having an elongated groove through a portion of the housing body; at least one blade received in a portion of the elongated groove wherein the at least one blade is coupled to the housing body with a free-floating member and at least one blade extension and held in a retracted in-flight position by at least one spring member, wherein the at least one blade comprises a second elongated groove for receiving the free-floating member, wherein the free-floating member is configured to move freely within the second elongated groove within the at least one blade, and wherein the free-floating member is movable in a horizontal direction and a vertical direction relative to the housing body.

18. The broadhead as described in claim 17, wherein the at least one spring member is attached to a portion of the housing body, the at least one spring member comprises a bump-out portion.

19. The broadhead as described in claim 17, wherein the at least one spring member is attached to the at least one blade.

20. The broadhead as described in claim 17, wherein the at least one spring member is attached to the at least one blade and clips onto a portion of an extension or pin that is connected to the housing body.

21. The broadhead as described in claim 17, wherein the at least one spring member is a portion of the at least one blade that pries against a cross member and/or the housing body.

22. The broadhead as described in claim 17, wherein the at least one spring member is a portion of the at least one blade that pries against a portion of the housing body in the elongated groove.

23. A broadhead comprising:

a housing body having an elongated groove through a portion of the housing body;

an opening in the housing body for receiving a blade coupling member for coupling at least one blade, wherein the opening in the housing body is covered to contain the blade coupling member within the housing body and, wherein the blade coupling member is free-floating and movable within the elongated groove of the housing body and is movable in a horizontal direction and a vertical direction relative to the housing body.

24. The broadhead as described in claim 23, wherein the at least one blade is received within the elongated groove of the housing body, the at least one blade having a second elongated groove for receiving the blade coupling member.

25. The broadhead as described in claim 23, wherein the opening in the housing body receives a cross member configured to prevent the blade coupling member from being released from the housing body.

26. The broadhead as described in claim 25, wherein the at least one blade pries against the cross member to hold the at least one blade in a locked position.

27. The broadhead as described in claim 23, wherein at least two overlapping blades are received within the elongated groove; the at least two overlapping blades are coupled together with the free-floating blade coupling member.

28. The broadhead as described in claim 23, wherein the at least one blade has an extension to hold the at least one blade against the housing body.

29. A broadhead comprising:

a housing body having an elongated groove through a portion of the housing body;

an opening in the housing body for receiving a blade coupling member for coupling at least one blade, wherein the opening in the housing body receives a cross member configured to prevent the blade coupling member from being released from the housing body and, wherein the blade coupling member is free-floating and movable within the elongated groove of the housing body and is movable in a horizontal direction and a vertical direction relative to the housing body.

30. A broadhead comprising:

at least two overlapping blades received within an elongated groove of a body, each blade coupled together with a free-floating movable member, wherein the free-floating movable member is configured to move freely within the elongated groove of the body, wherein at least one blade extension on at least one of the at least two overlapping blades pushes against a portion of the body to lock the respective blade into an expanded cutting position, and wherein the free-floating movable member is movable in a horizontal direction and a vertical direction relative to the housing body.

* * * * *